US011753815B2

(12) United States Patent
Thomas, Sr.

(10) Patent No.: US 11,753,815 B2
(45) Date of Patent: Sep. 12, 2023

(54) MODULAR BUILDING SYSTEM

(71) Applicant: Kevin B. Thomas, Sr., Cullman, AL (US)

(72) Inventor: Kevin B. Thomas, Sr., Cullman, AL (US)

( * ) Notice: Subject to any disclaimer, the term of this patent is extended or adjusted under 35 U.S.C. 154(b) by 160 days.

(21) Appl. No.: 17/495,592

(22) Filed: Oct. 6, 2021

(65) Prior Publication Data

US 2023/0108650 A1 Apr. 6, 2023

(51) Int. Cl.

| | |
|---|---|
| ***E04B 1/61*** | (2006.01) |
| ***E04B 1/41*** | (2006.01) |
| ***E04C 2/34*** | (2006.01) |
| ***E04C 2/38*** | (2006.01) |
| ***E04B 2/00*** | (2006.01) |
| ***E04H 1/12*** | (2006.01) |
| *E04B 1/38* | (2006.01) |

(52) U.S. Cl.

CPC ..... *E04B 1/6108* (2013.01); *E04B 1/40* (2013.01); *E04B 2/00* (2013.01); *E04C 2/34* (2013.01); *E04C 2/38* (2013.01); *E04C 2/46* (2013.01); *E04H 1/1205* (2013.01); *E04B 2001/405* (2013.01); *E04B 2001/6191* (2013.01); *E04B 2001/6195* (2013.01); *E04C 2002/3488* (2013.01)

(58) Field of Classification Search

None

See application file for complete search history.

(56) References Cited

U.S. PATENT DOCUMENTS

| | | | | |
|---|---|---|---|---|
| 3,265,879 | A * | 8/1966 | Ford | E04B 9/127 52/656.1 |
| 3,982,362 | A | 9/1976 | Moore | |
| 4,000,589 | A | 1/1977 | Bianchini | |
| 4,631,877 | A | 12/1986 | Molodecki | |
| 5,426,900 | A | 6/1995 | Springer | |
| 5,493,839 | A | 2/1996 | Sax et al. | |
| 5,749,387 | A | 5/1998 | Thompson | |
| 6,009,673 | A | 1/2000 | Adams | |
| 6,195,950 | B1 * | 3/2001 | Harris | E04B 1/10 52/270 |
| 6,286,269 | B1 | 9/2001 | Marcum | |
| 6,591,558 | B1 * | 7/2003 | De Zen | E04C 2/20 52/91.1 |
| 7,188,635 | B2 | 3/2007 | Johnson | |
| 7,467,469 | B2 | 12/2008 | Wall | |
| 8,881,458 | B2 | 11/2014 | Snider et al. | |
| 8,925,283 | B2 | 1/2015 | Lemieux | |
| 9,388,564 | B2 | 7/2016 | Garcia et al. | |
| 9,441,356 | B2 | 9/2016 | Welcel | |
| 10,221,556 | B2 | 3/2019 | Noble | |
| 10,538,905 | B2 | 1/2020 | Pirrung | |

(Continued)

*Primary Examiner* — Joshua K Ihezie

(74) *Attorney, Agent, or Firm* — Olav M. Underdal; IDP Patent Services

(57) ABSTRACT

A modular building system, includes a modular building assembly, including a base mounting structure with first and second base angle brackets; a left receiving wall assembly, including a left primary wall assembly, and left front and left rear corner brackets; a right primary wall assembly, and right front and right rear corner brackets; and front and rear wall assemblies; and a platform with legs; such that the modular building assembly is positionable on a top surface of the platform.

29 Claims, 46 Drawing Sheets

(56) References Cited

U.S. PATENT DOCUMENTS

| | | | | |
|---|---|---|---|---|
| 2007/0107328 | A1 | 5/2007 | Munch | |
| 2019/0367263 | A1 | 12/2019 | Chabot | |
| 2020/0399917 | A1* | 12/2020 | McDonald | E04H 1/005 |

* cited by examiner

MODULAR BUILDING SYSTEM

CROSS-REFERENCE TO RELATED APPLICATIONS

N/A.

FIELD OF THE INVENTION

The present invention relates generally to the field of building systems and method, and more particularly to methods and systems for modular prefabricated buildings.

BACKGROUND OF THE INVENTION

Modular prefabricated building systems are prevalent as a means of low-cost and fast installation of building for industrial, residential, and recreational use.

However, such systems typically require use of heavy machinery and cannot be assembled by a single person.

As such, considering the foregoing, it may be appreciated that there continues to be a need for novel and improved devices and methods for modular prefabricated buildings.

SUMMARY OF THE INVENTION

The foregoing needs are met, to a great extent, by the present invention, wherein in aspects of this invention, enhancements are provided to the existing model of modular prefabricated buildings.

In an aspect, a modular building system can include:

a) a platform, which can include legs, a step and a porch surface; and b) a modular building assembly;

such that the modular building assembly can be positioned on a top surface of the platform, such that the porch surface is exposed in a front of the modular building assembly.

In a related aspect, the modular building assembly can include:

a) a base mounting structure, which can include:

i. A first base angle bracket; and ii. A second base angle bracket;

wherein each base angle bracket has an L-shaped profile, with a vertical portion and a horizontal portion, such that a center line of each base angle bracket is bent at a 90-degree angle;

such that a first outer end of the first base angle bracket is connected to a first outer end of the second base angle bracket;

such that a second outer end of the first base angle bracket is connected to a second outer end of the second base angle bracket;

such that the base mounting structure forms a rectangular structure (which as shown can be quadratic), which includes a rectangular vertical band formed by vertical portions of the first and second base angle bracket, and vertical flanges protruding from lower sides of the rectangular vertical band;

b) a left receiving wall assembly, which can include:

i. a left primary wall assembly;

ii. a left front corner bracket, which is mounted on a front vertical side of the left primary wall assembly; and iii. a left rear corner bracket, which is mounted on a rear vertical side of the left primary wall assembly;

such that the left receiving wall assembly is mounted on a left side of the base mounting structure;

c) a right receiving wall assembly, which can include:

i. a right primary wall assembly;

ii. a right front corner bracket, which is mounted on a front vertical side of the right primary wall assembly; and iii. a right rear corner bracket, which is mounted on a rear vertical side of the right primary wall assembly;

such that the right receiving wall assembly is mounted on an opposing right side of the base mounting structure;

such that a front mounting opening is formed between the left front corner bracket and the right front corner bracket; and such that a rear mounting opening is formed between the left rear corner bracket and the right rear corner bracket;

d) a front wall assembly, which is mounted in the front mounting opening; and e) a rear wall assembly, which is mounted in the rear mounting opening; and f) a roof assembly, which can be mounted on a top of the left receiving wall assembly, the rear wall assembly, the right receiving wall assembly, and the front wall assembly, wherein the roof assembly can include:

i. An upper roof angle bracket; and ii. A lower roof angle bracket;

wherein each roof angle bracket can have an L-shaped profile, with a vertical portion and a horizontal portion, such that a center line of each roof angle bracket is bent at a 90-degree angle;

such that a first outer end of the upper roof angle bracket is connected to a first outer end of the lower roof angle bracket;

such that a second outer end of the first base angle bracket is connected to a second outer end of the lower roof angle bracket;

such that the roof assembly forms a rectangular structure (which as shown can be quadratic), which includes a rectangular vertical band formed by vertical portions of the upper roof angle brackets, and a horizontal flange protruding from upper sides of the rectangular vertical band.

In a related aspect, each corner bracket of the left front corner bracket, the left rear corner bracket, the right front corner bracket, and the right rear corner bracket further comprises:

a) a u-shaped elongated corner bracket portion, which is configured to be positioned on and along a vertical side of a corresponding wall assembly of the left primary wall assembly and the right primary wall assembly, i.e. such that the u-shaped elongated corner bracket portion is positioned around and along the vertical side of a wall assembly, and slides onto the vertical side of the corresponding wall assembly, wherein the u-shaped elongated corner bracket portion can further include:

i. an outer elongated flange, which is configured to be positioned along an outside surface of the corresponding wall assembly, adjacent to the vertical side of the wall assembly;

ii. an inner elongated flange, which is configured to be positioned along an inside surface of the corresponding wall, adjacent to the vertical side of the wall assembly; and iii. an elongated bridge portion, which is connected between proximal ends of the outer elongated flange and the inner elongated flange, such that the elongated bridge portion is adjacent to and substantially parallel with the vertical side of the corresponding wall assembly; and b) an inward elongated flange portion, which is perpendicularly mounted along a distal end of the inner elongated flange, such that the inward elongated flange portion can hold a front (or rear) second corresponding wall assembly of the front wall assembly and the rear wall assembly in position in the front (or rear) corresponding mounting opening of the front mounting opening and the rear mounting opening, such that an outer surface of the front (or rear) second corresponding wall assembly is flush with an outer surface of the elongated bridge portion of the corner bracket.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

FIG. 35 is a side perspective view of part of a slidable window assembly with a left slidable screw assembly, according to an embodiment of the invention.

DETAILED DESCRIPTION

Figure 1:
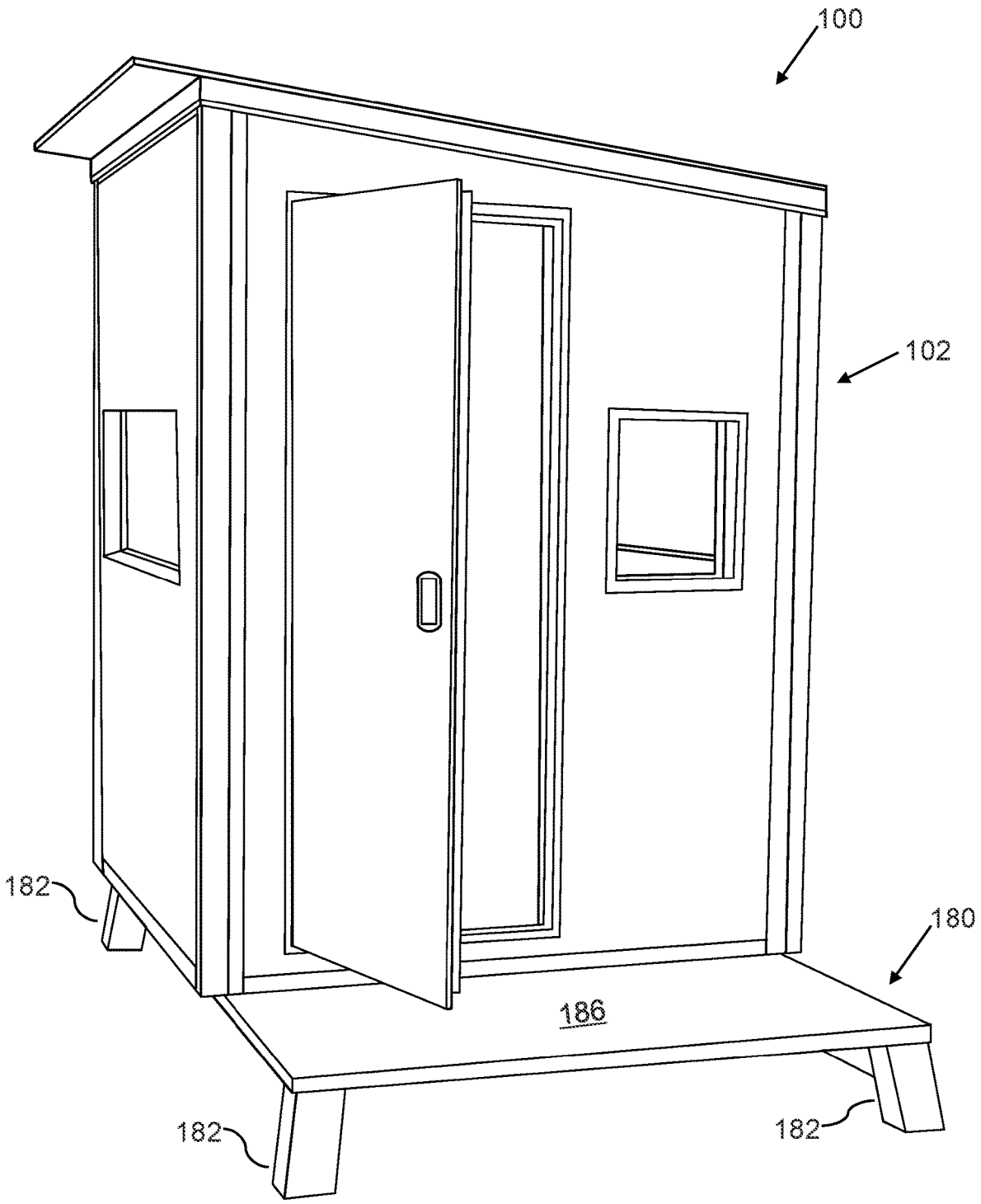
FIG. 1 is a perspective view of a modular building system, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of a modular building system 100 with reference to FIG. 1, in such manner that like reference numerals refer to like components throughout; a convention that we shall employ for the remainder of this specification.

In an embodiment, as shown in FIGS. 1, 2A, 2B, and 4A, a modular building system 100 can include:

a) a platform 180, which can include legs 182, a step 484 and a porch surface 186; and b) a modular building assembly 102;

such that the modular building assembly 102 can be positioned on a top surface of the platform 180, when the legs of the platform are positioned on a mounting surface, wherein the porch surface 186 is exposed in a front of the modular building assembly 102.

Figure 4A:
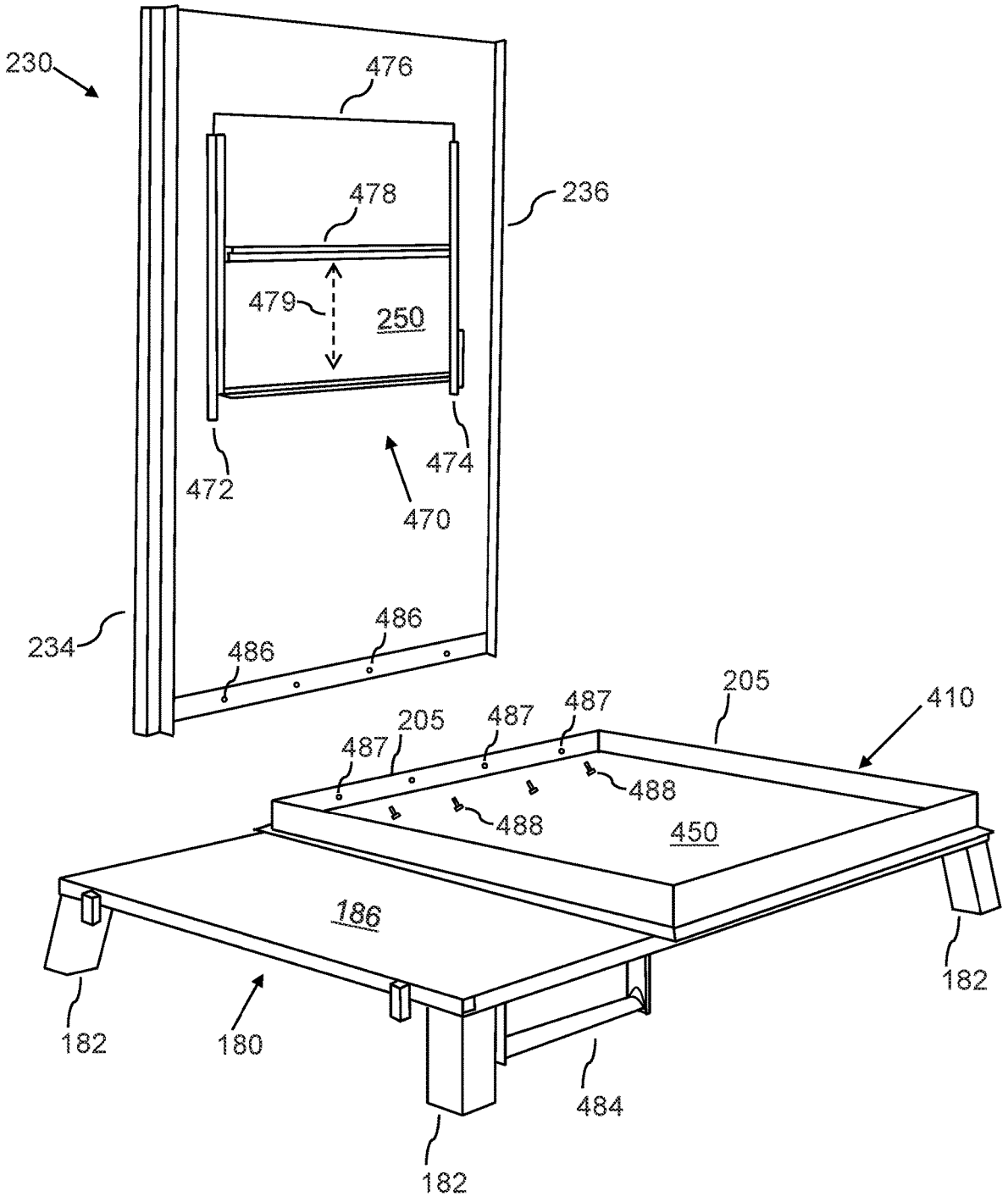
FIG. 4A is a perspective view of a modular building system during installation, according to an embodiment of the invention.

In a related embodiment, as shown in FIGS. 1, 2A, 2B, 2D, and 2E, the modular building assembly 102 can include:

a) a base mounting structure 410, as shown in FIG. 4A, which can include:

i. A first base angle bracket 205, as shown in FIG. 5A-5D; and ii. A second base angle bracket 205;

wherein each base angle bracket 205 has an L-shaped cross-sectional profile, with a vertical portion 512 and a horizontal portion 514, such that a lateral center line 506 of each base angle bracket 205 is bent at a 90-degree angle;

such that a first outer end of the first base angle bracket 205 is connected to a first outer end of the second base angle bracket 205;

such that a second outer end of the first base angle bracket 205 is connected to a second outer end of the second base angle bracket 205;

such that the base mounting structure 410 forms a rectangular structure (which as shown can be quadratic), which includes a rectangular vertical band formed by vertical portions of the first and second base angle bracket 205, and vertical flanges protruding from lower sides of the rectangular vertical band;

b) a left receiving wall assembly 230, which can include:

i. a left primary wall assembly 232;

ii. a left front corner bracket 203, 234, which is mounted along a front vertical side of the left primary wall assembly 232; and iii. a left rear corner bracket 203, 236, which is mounted along a rear vertical side of the left primary wall assembly 232;

such that the left receiving wall assembly is mounted on a left side of the base mounting structure 410;

c) a right receiving wall assembly 440, which can include:

i. a right primary wall assembly 242;

ii. a right front corner bracket 203, 244, which is mounted along a front vertical side of the right primary wall assembly 242; and iii. a right rear corner bracket 203, 246, which is mounted along a rear vertical side of the right primary wall assembly 242;

such that the right receiving wall assembly 440 is mounted on an opposing right side of the base mounting structure 410;

such that a front mounting opening 282 is formed between the left front corner bracket 234 and the right front corner bracket 244; and such that a rear mounting opening 284 is formed between the left rear corner bracket 236 and the right rear corner bracket 246;

d) a front wall assembly 256, which is mounted in the front mounting opening 282; and e) a rear wall assembly 258, which is mounted in the rear mounting opening 284; and f) a roof assembly 460, which is mounted on a top of the left receiving wall assembly 230, the rear wall assembly 258, the right receiving wall assembly 440, and the front wall assembly 256, wherein the roof assembly 460 can include:

i. An upper roof angle bracket 218, as shown in FIGS. 4F and 18A-18D; and ii. A lower roof angle bracket 219, as shown in FIGS. 4F and 19A-19D;

wherein each roof angle bracket 218, 219 has an L-shaped profile, with a vertical portion 462 and a horizontal portion 464, such that a center line of each roof angle bracket 218, 219 is bent at a 90-degree angle;

such that a first outer end of the upper roof angle bracket 218 is connected to a first outer end of the lower roof angle bracket 219;

such that a second outer end of the first base angle bracket 205 is connected to a second outer end of the lower roof angle bracket 219;

such that the roof assembly 460 forms a rectangular structure (which as shown can be quadratic), which includes a rectangular vertical band formed by vertical portions of the upper roof angle brackets 218, 219, and a horizontal flange protruding from upper sides of the rectangular vertical band.

Figure 3A:
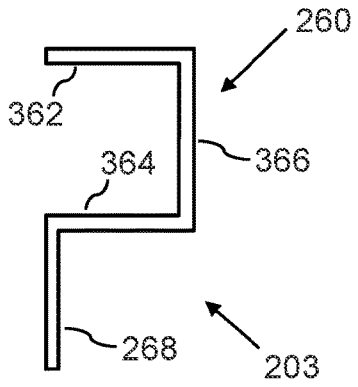
FIG. 3A is a front view of a modular side bracket, according to an embodiment of the invention.
Figure 3B:
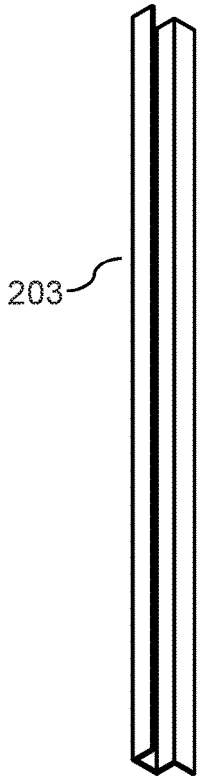
FIG. 3B is a bottom perspective view of a modular side bracket, according to an embodiment of the invention.
Figure 3C:
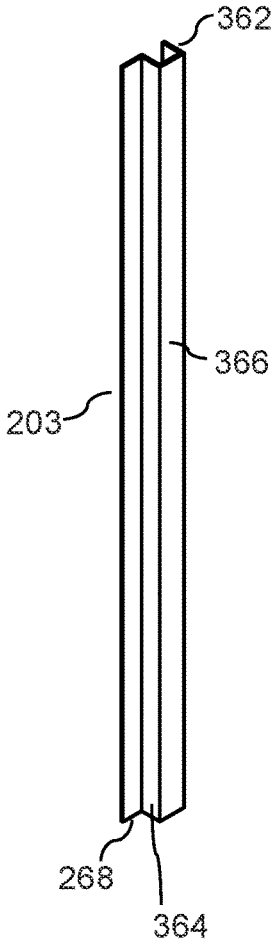
FIG. 3C is a top perspective view of a modular side bracket, according to an embodiment of the invention.
Figure 3D:
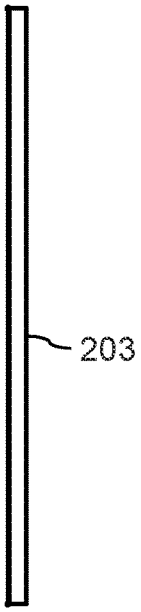
FIG. 3D is a side view of a modular side bracket, according to an embodiment of the invention.
Figure 3E:
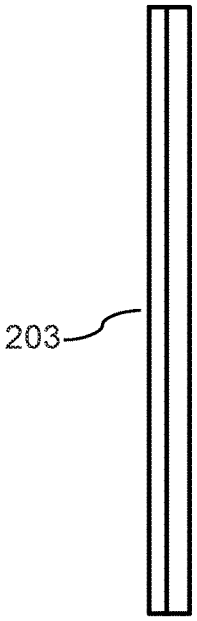
FIG. 3E is a front view of a modular side bracket, according to an embodiment of the invention.

In a related embodiment, as shown in FIG. 3A, each corresponding corner bracket 234, 236, 244, 246 of the left front corner bracket 234, the left rear corner bracket 236, the right front corner bracket 244, and the right rear corner bracket 246 can further include:

a) a u-shaped elongated corner bracket portion 260, which is configured to be positioned on and along a vertical side of a corresponding wall assembly 232, 242 of the left primary wall assembly 232 and the right primary wall assembly 242, i.e. such that the u-shaped elongated corner bracket portion 260 is positioned around and along the vertical side of a wall assembly 232, 242, and slides onto the vertical side of the corresponding wall assembly 232, 242, wherein the u-shaped elongated corner bracket portion 260 can further include:

i. an outer elongated flange 362, which is configured to be positioned along an outside surface of the corresponding wall assembly 232, 242, adjacent to the vertical side of the wall assembly 232, 242;

ii. an inner elongated flange 364, which is configured to be positioned along an inside surface of the corresponding wall assembly 232, 242 adjacent to the vertical side of the wall assembly 232, 242; and iii. an elongated bridge portion 366, which is connected between inner ends (i.e., proximal ends) of the outer elongated flange 362 and the inner elongated flange 364, such that the elongated bridge portion 366 is adjacent to and substantially parallel with the vertical side of the corresponding wall assembly 232, 242;

b) an inward elongated flange portion 268, which is perpendicularly mounted along an outer end (i.e., a distal end) of the inner elongated flange 364, such that the inward elongated flange portion 268 can hold a front (or rear) second corresponding wall assembly 256, 258 of the front wall assembly 256 and the rear wall assembly 258 in position in the front (or rear) corresponding mounting opening 282, 284 of the front mounting opening 282 and the rear mounting opening 284, such that an outer surface 292 of the front (or rear) second corresponding wall assembly 256, 258 is substantially flush with an outer surface 294 of the elongated bridge portion 366 of the corresponding corner bracket 234, 236, 244, 246.

Figure 4B:
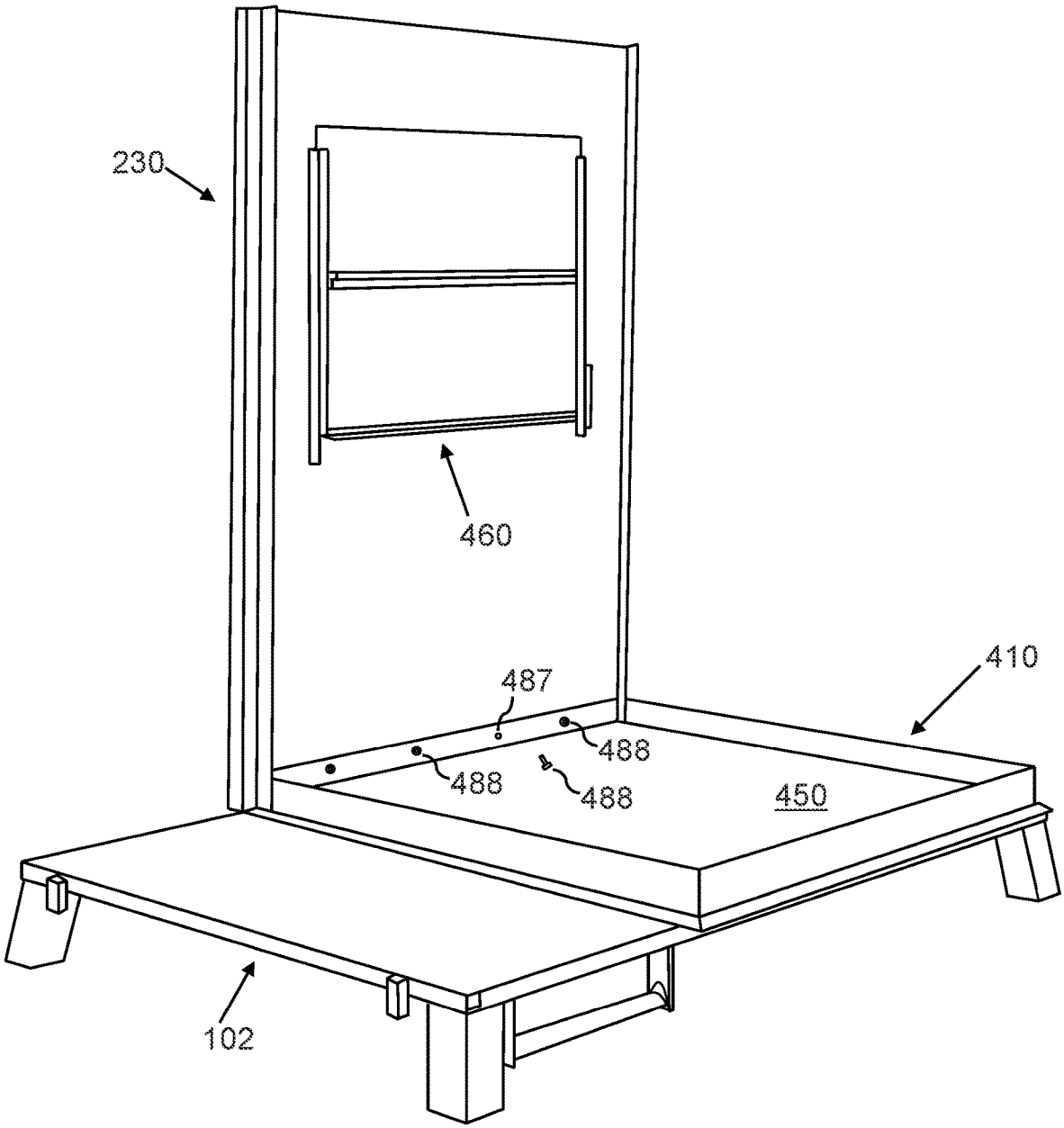
FIG. 4B is a perspective view of a modular building system during installation, according to an embodiment of the invention.
Figure 4C:
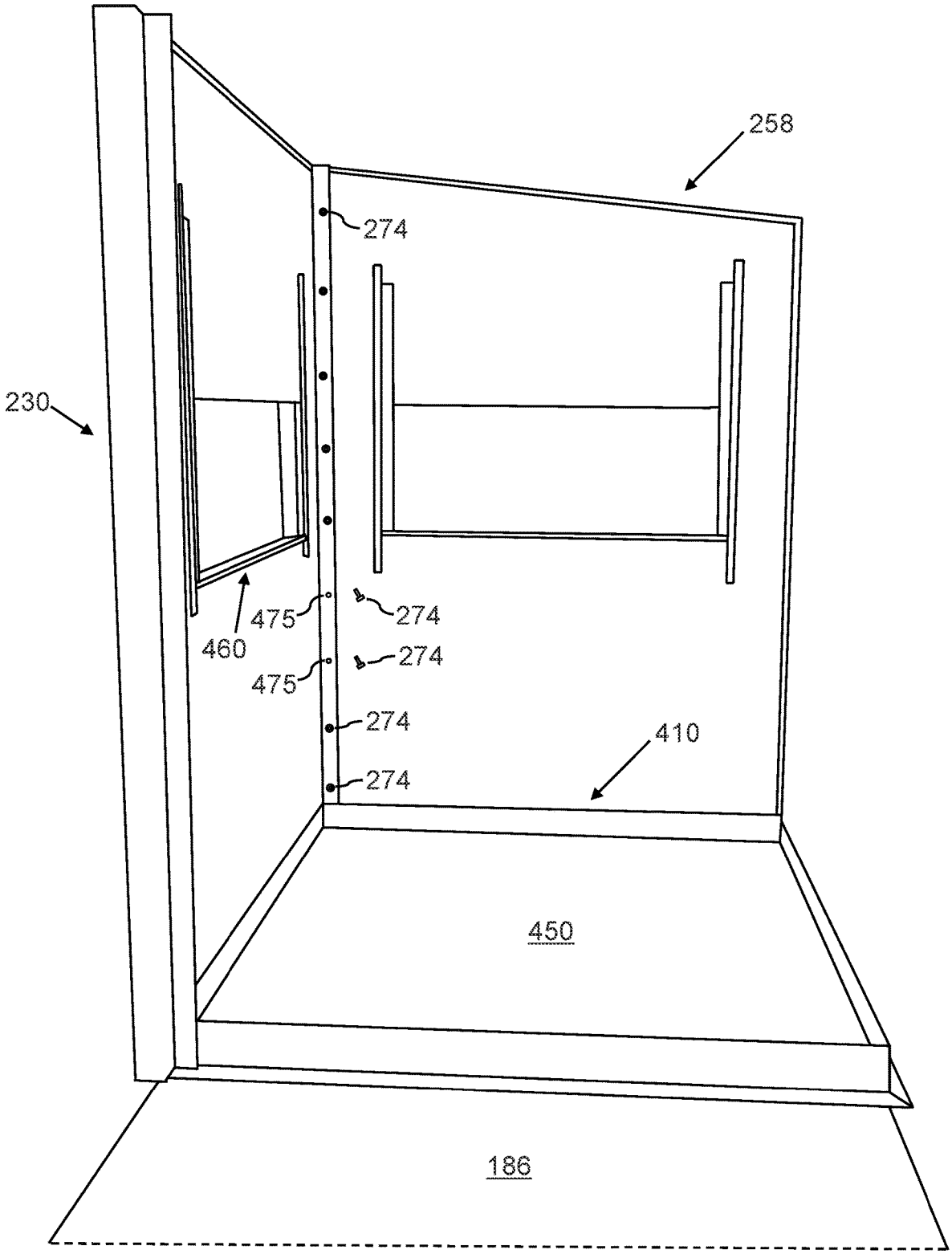
FIG. 4C is a perspective view of a modular building system during installation, according to an embodiment of the invention.
Figure 4D:
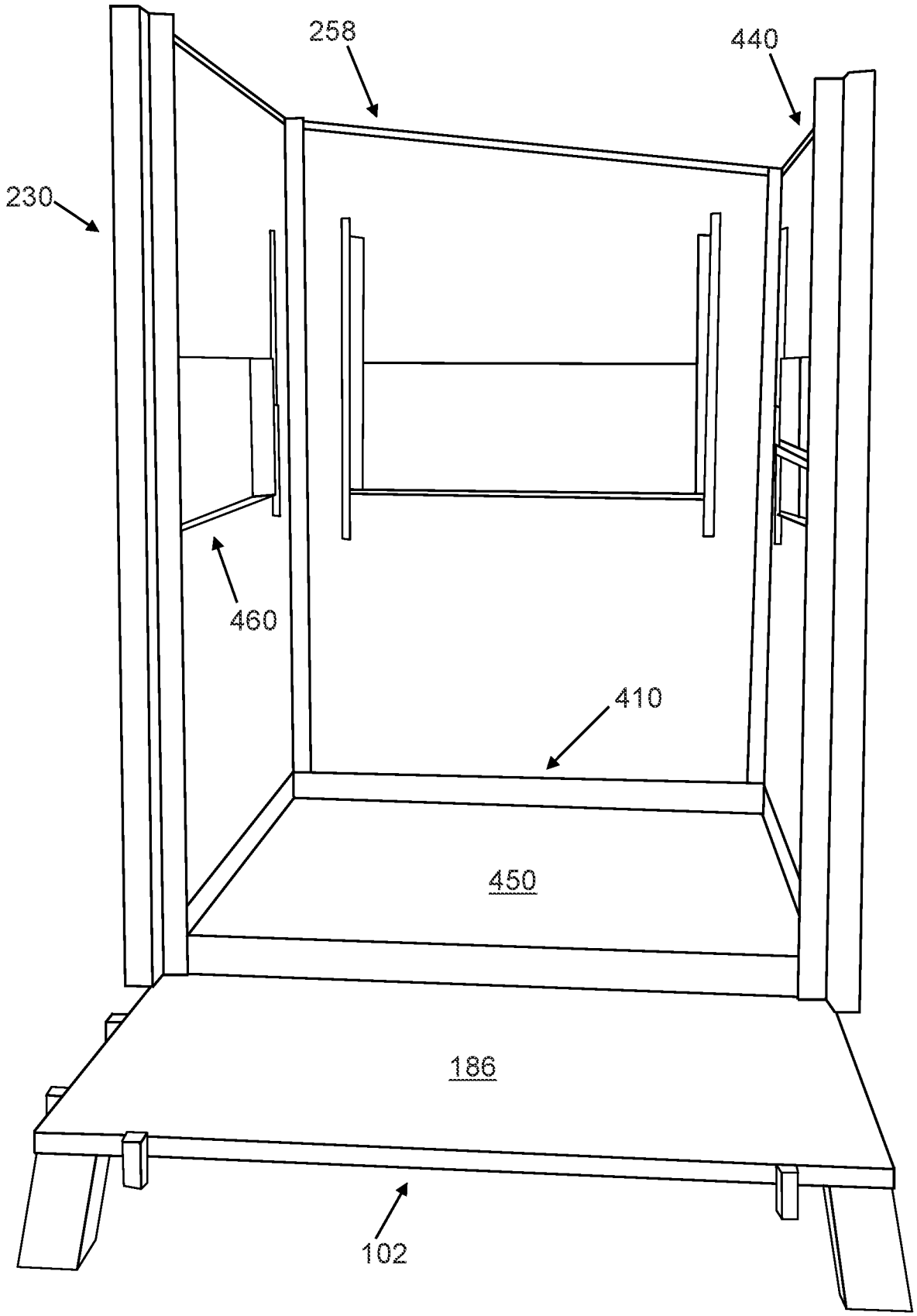
FIG. 4D is a perspective view of a modular building system during installation, according to an embodiment of the invention.
Figure 4E:
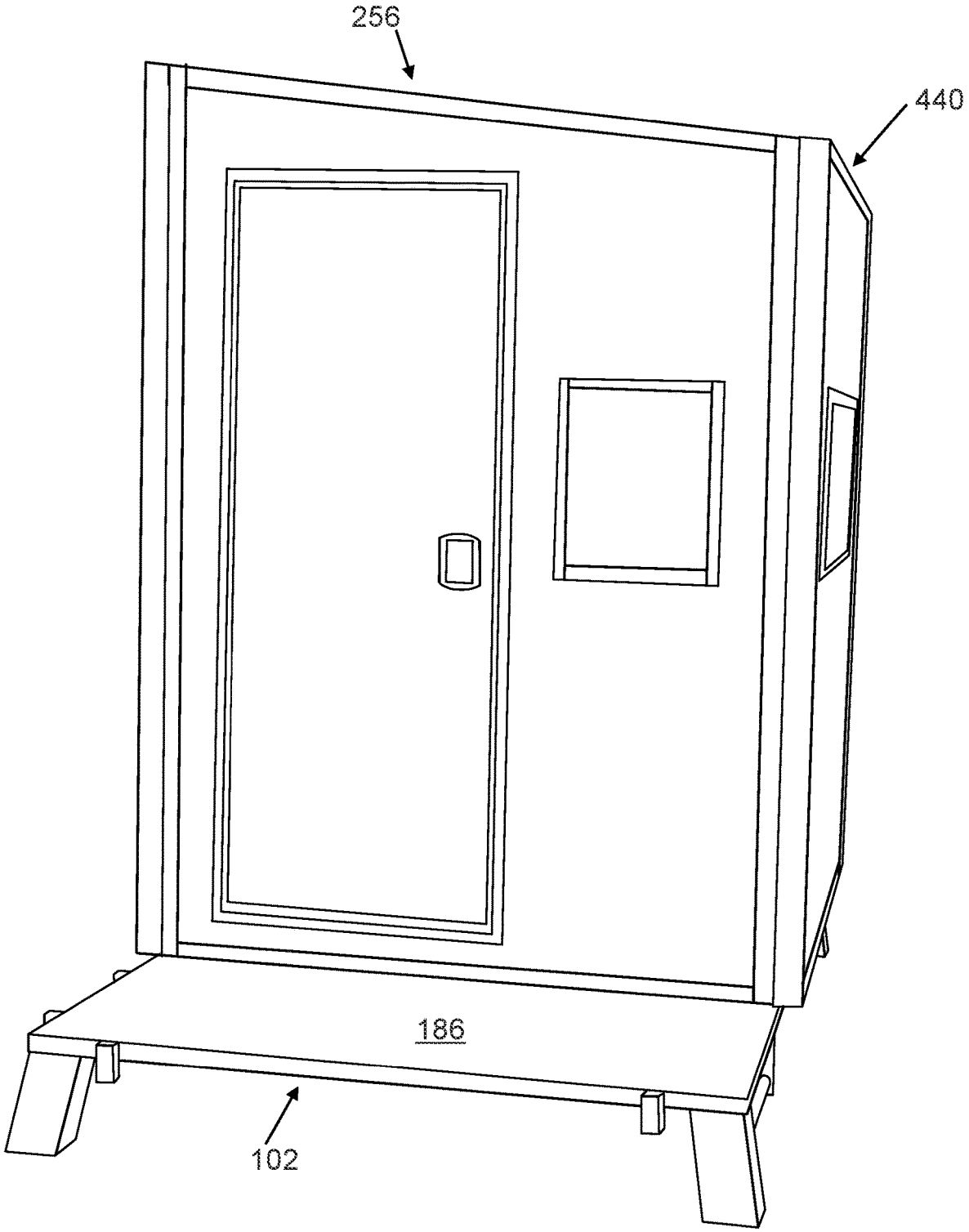
FIG. 4E is a perspective view of a modular building system during installation, according to an embodiment of the invention.
Figure 4F:
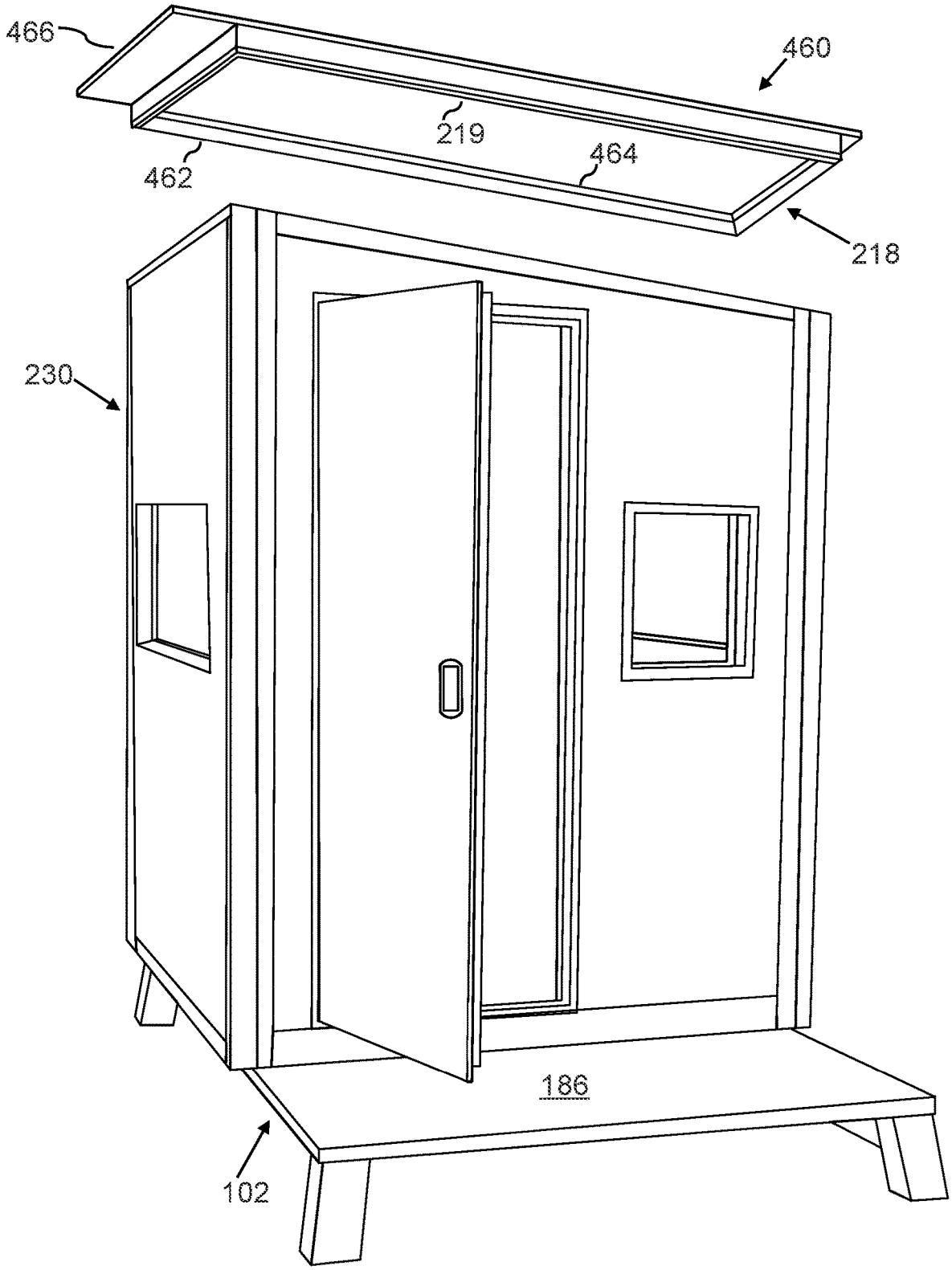
FIG. 4F is a perspective view of a modular building system during installation, according to an embodiment of the invention.
Figure 5A:
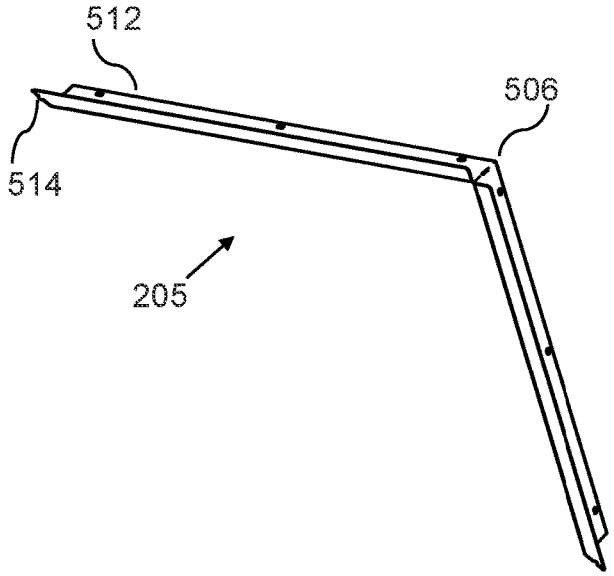
FIG. 5A is a perspective view of a base angle bracket, according to an embodiment of the invention.
Figure 5B:
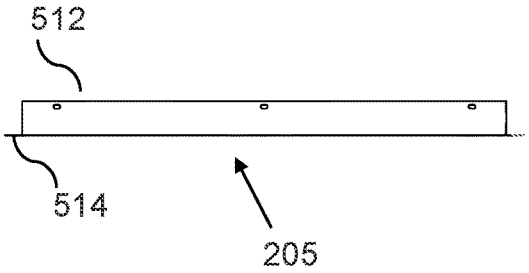
FIG. 5B is a side view of a base angle bracket, according to an embodiment of the invention.
Figure 5C:
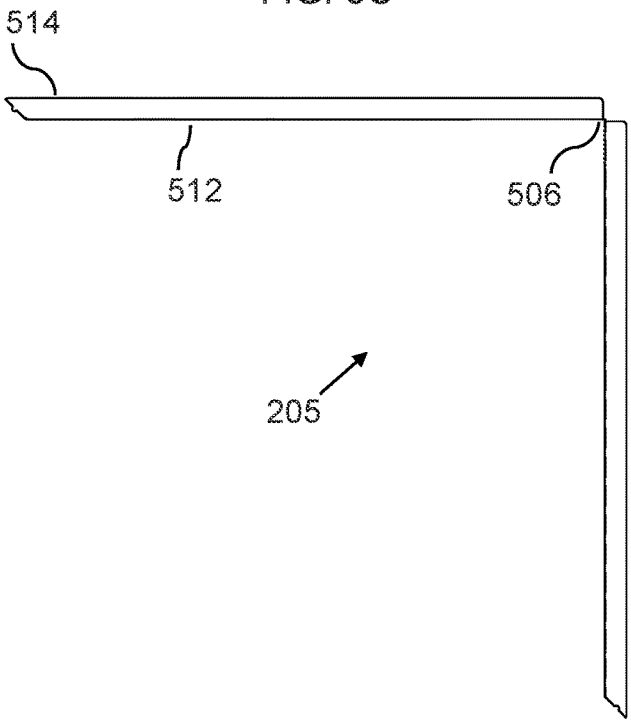
FIG. 5C is a top view of a base angle bracket, according to an embodiment of the invention.
Figure 5D:
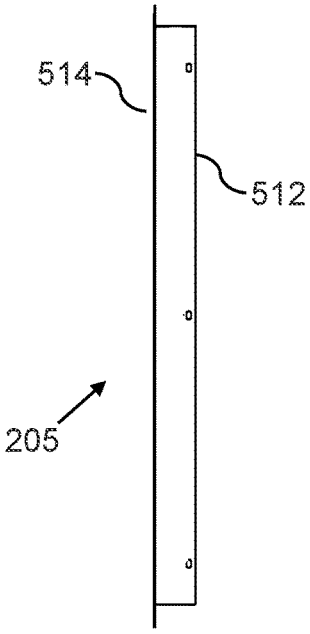
FIG. 5D is a front view of a base angle bracket, according to an embodiment of the invention.
Figure 6A:
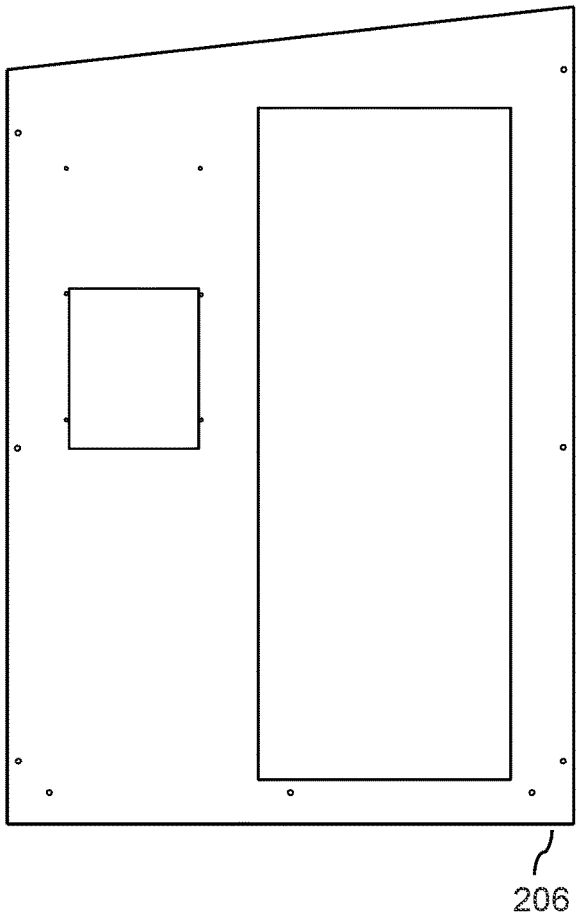
FIG. 6A is a front view of an inside sloped door panel, according to an embodiment of the invention.
Figure 6B:
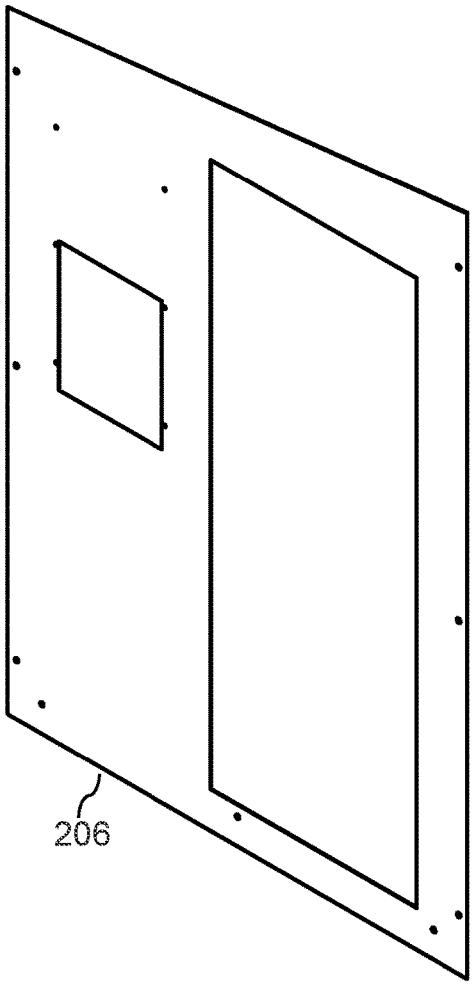
FIG. 6B is a perspective view of an inside sloped door panel, according to an embodiment of the invention.
Figure 7A:
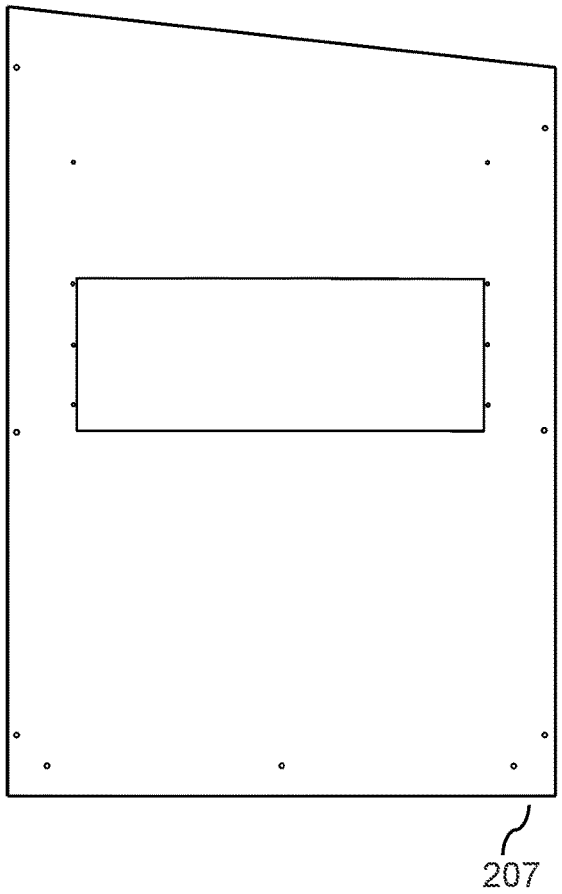
FIG. 7A is a front view of an inside sloped window wall, according to an embodiment of the invention.
Figure 7B:
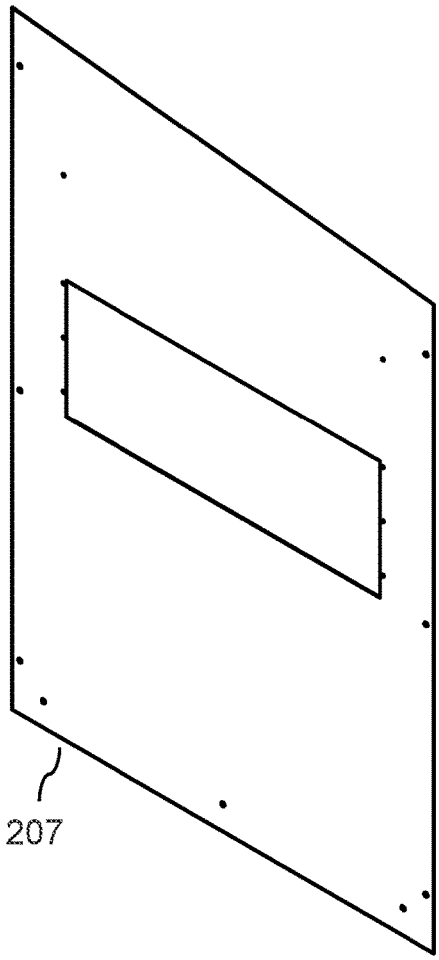
FIG. 7B is a perspective view of an inside sloped window wall, according to an embodiment of the invention.
Figure 8A:
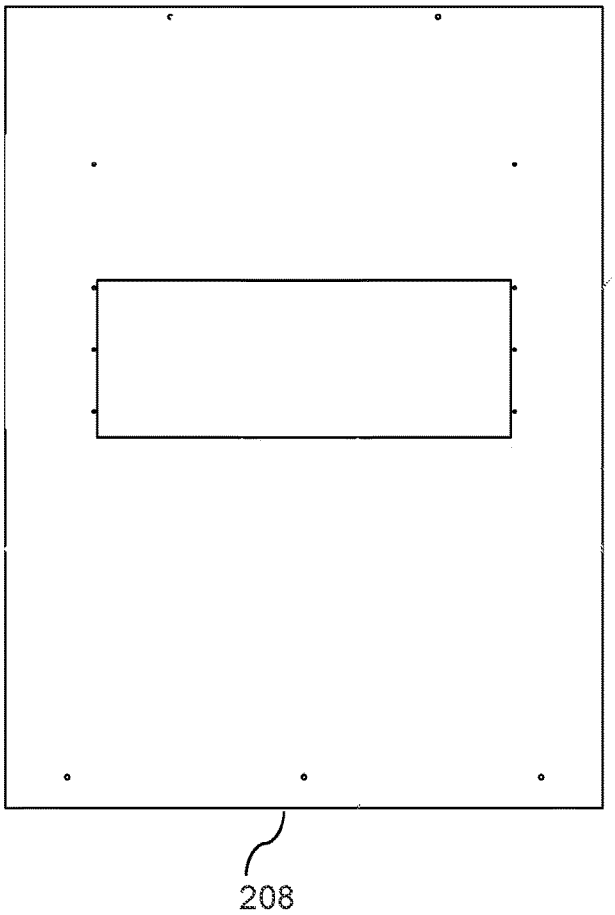
FIG. 8A is a front view of an inside tall wall panel, according to an embodiment of the invention.
Figure 8B:
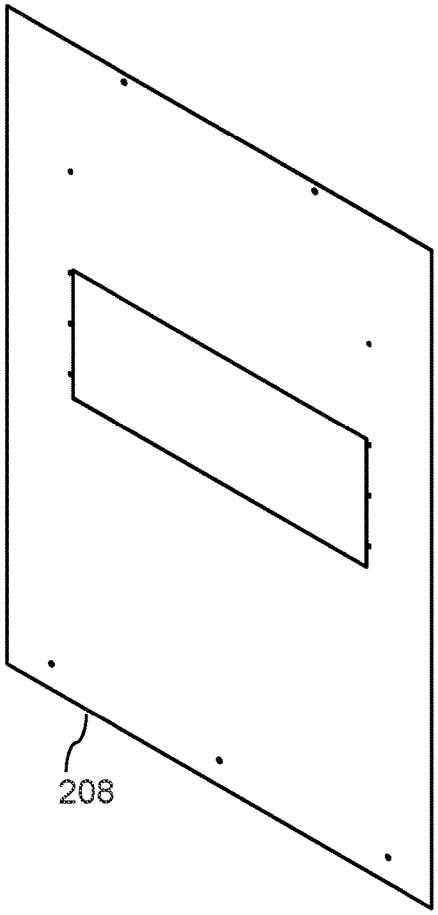
FIG. 8B is a perspective view of an inside tall wall panel, according to an embodiment of the invention.
Figure 9A:
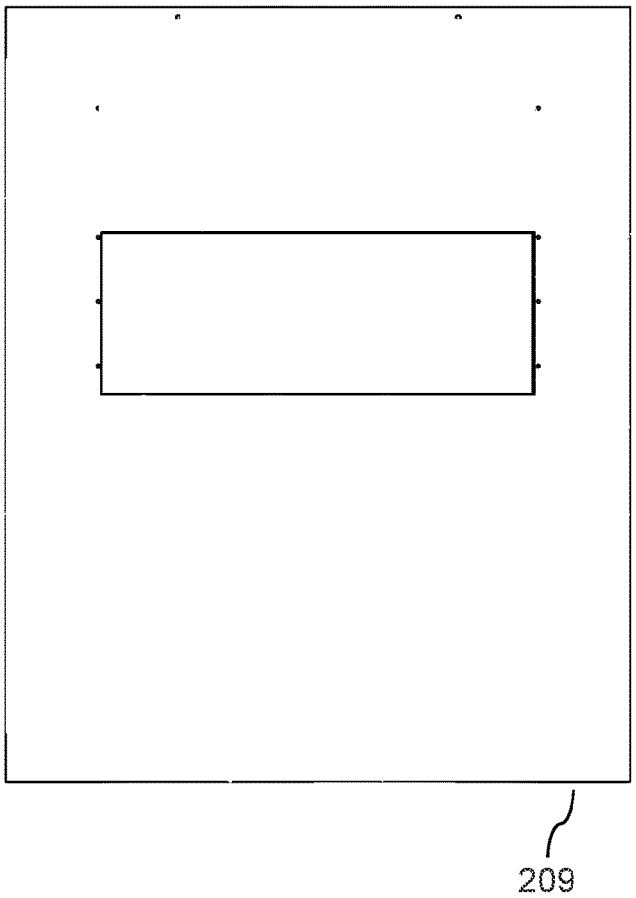
FIG. 9A is a front view of an inside short wall, according to an embodiment of the invention.
Figure 9B:
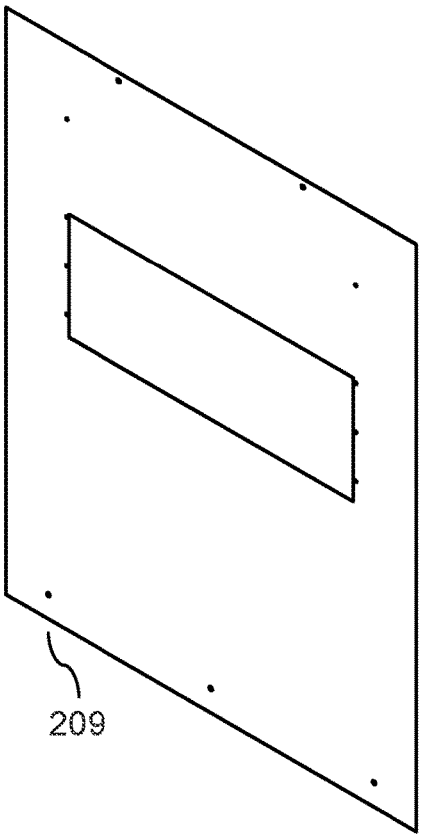
FIG. 9B is a perspective view of an inside short wall, according to an embodiment of the invention.
Figure 10A:
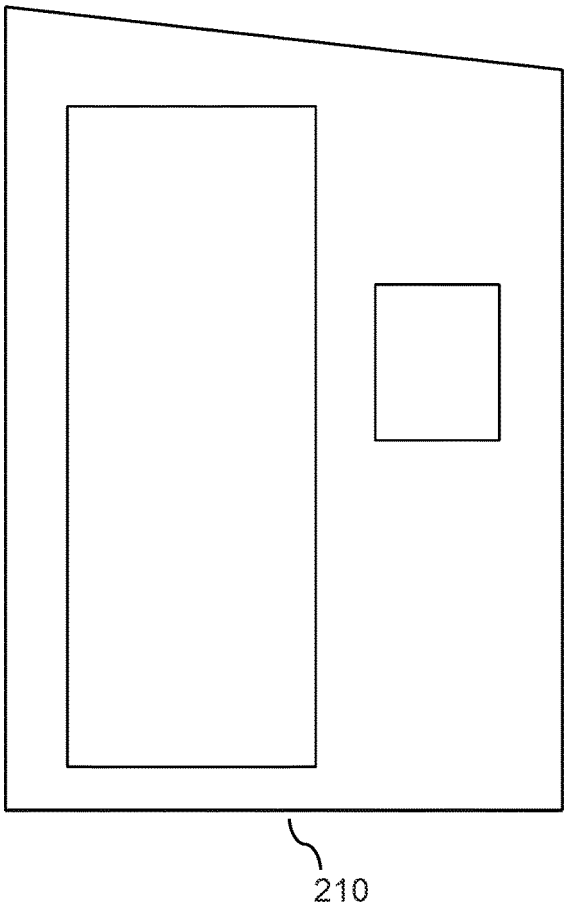
FIG. 10A is a front view of an outside door panel, according to an embodiment of the invention.
Figure 10B:
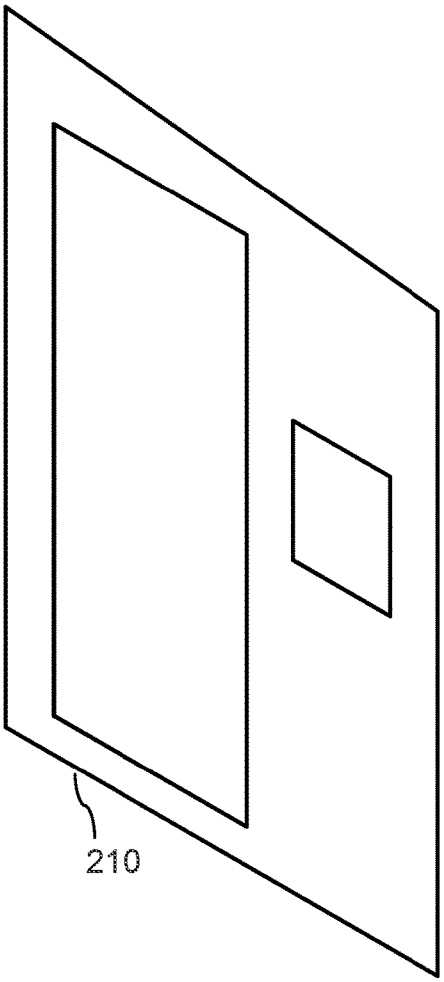
FIG. 10B is a perspective view of an outside door panel, according to an embodiment of the invention.
Figure 11A:
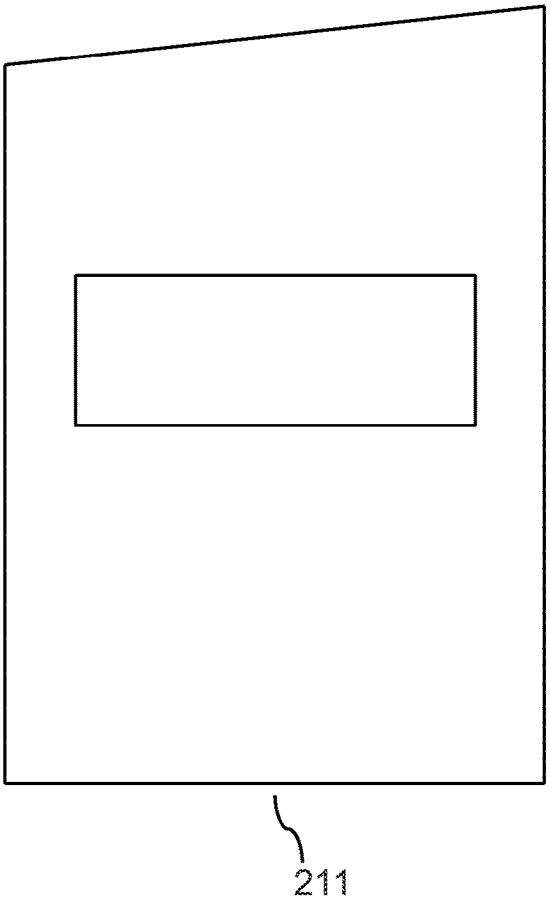
FIG. 11A is a front view of an outside sloped window wall, according to an embodiment of the invention.
Figure 11B:
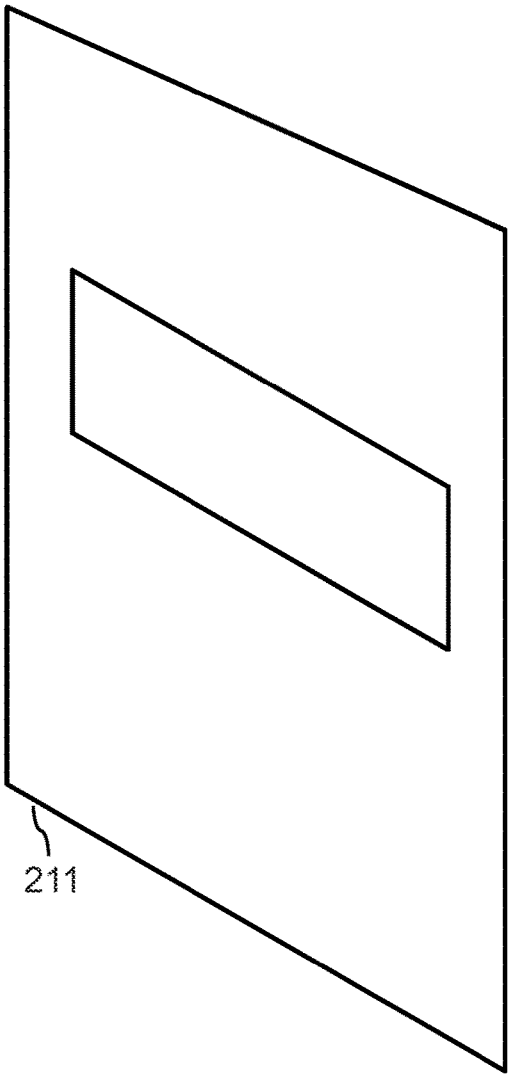
FIG. 11B is a perspective view of an outside sloped window wall, according to an embodiment of the invention.
Figure 12A:
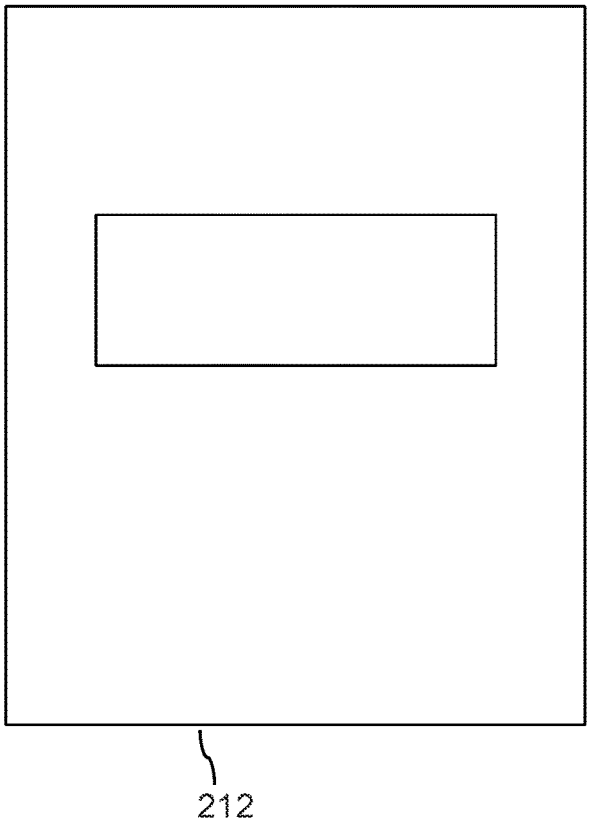
FIG. 12A is a front view of an outside short wall, according to an embodiment of the invention.
Figure 12B:
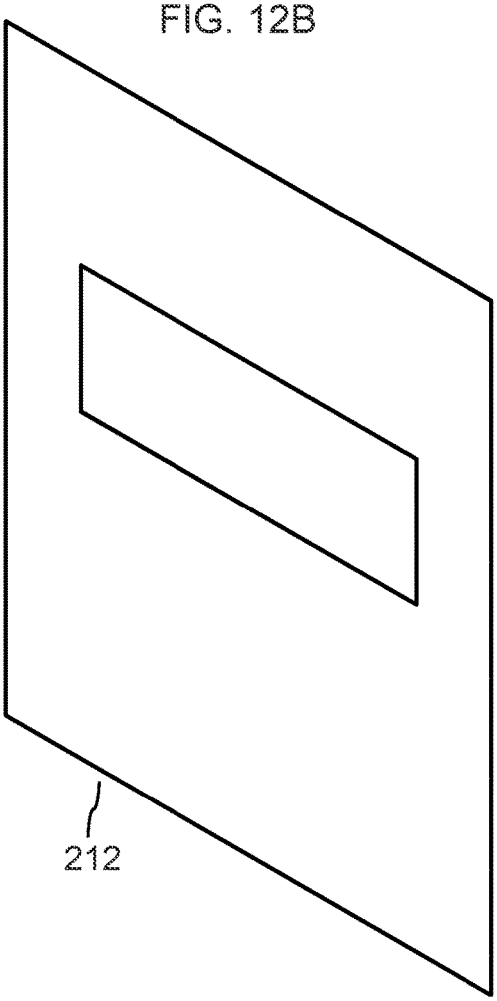
FIG. 12B is a perspective view of an outside short wall, according to an embodiment of the invention.
Figure 13A:
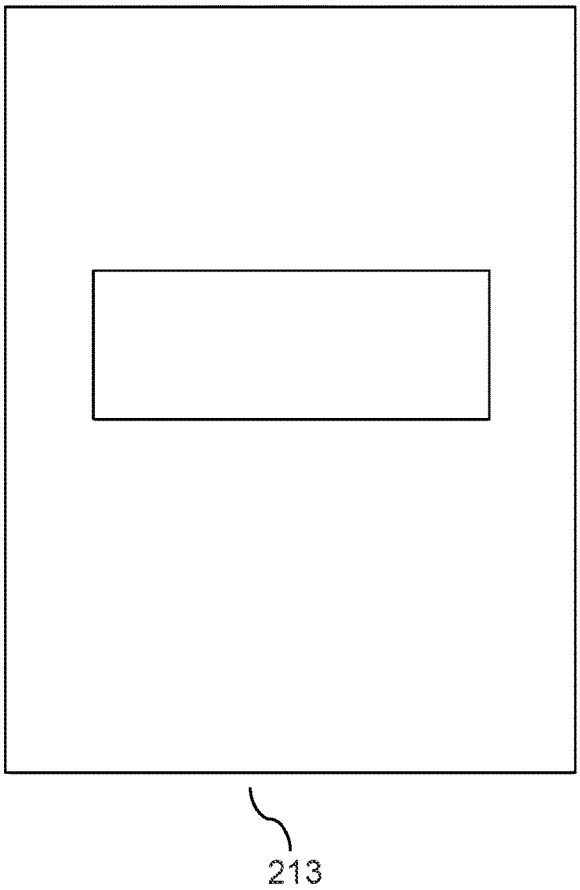
FIG. 13A is a front view of an outside tall wall panel, according to an embodiment of the invention.
Figure 13B:
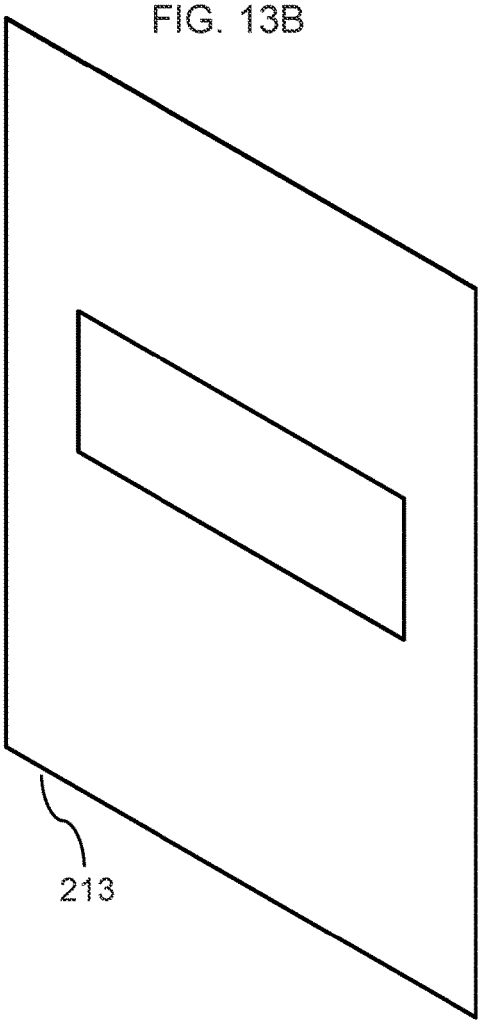
FIG. 13B is a perspective view of an outside tall wall panel, according to an embodiment of the invention.
Figure 14A:
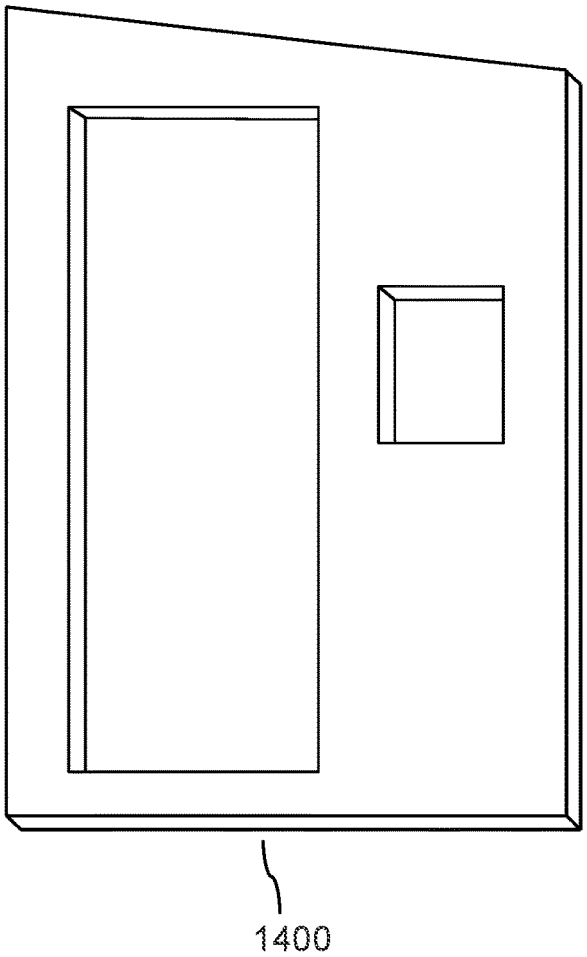
FIG. 14A is a front view of an intermediate sloped door panel, according to an embodiment of the invention.
Figure 14B:
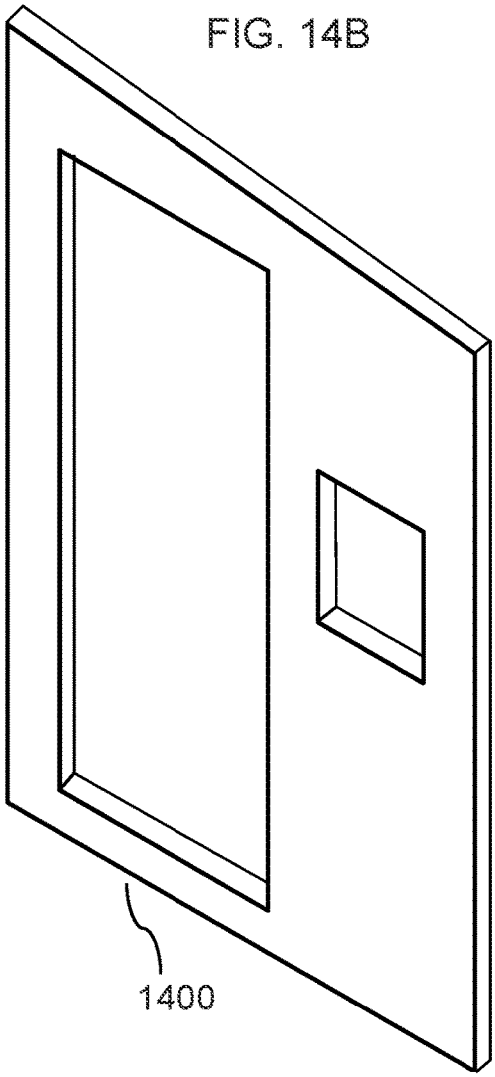
FIG. 14B is a perspective view of an intermediate sloped door panel, according to an embodiment of the invention.
Figure 15A:
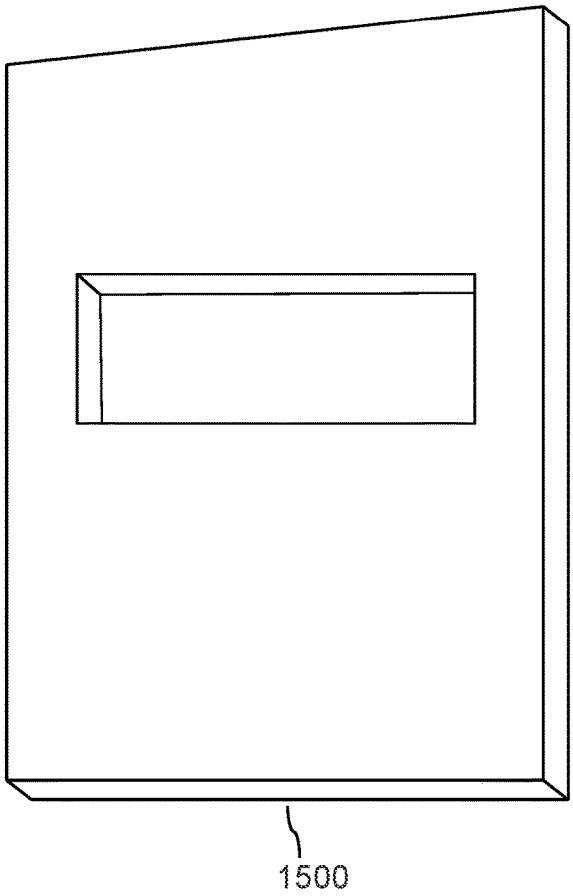
FIG. 15A is a front view of an intermediate sloped window wall, according to an embodiment of the invention.
Figure 15B:
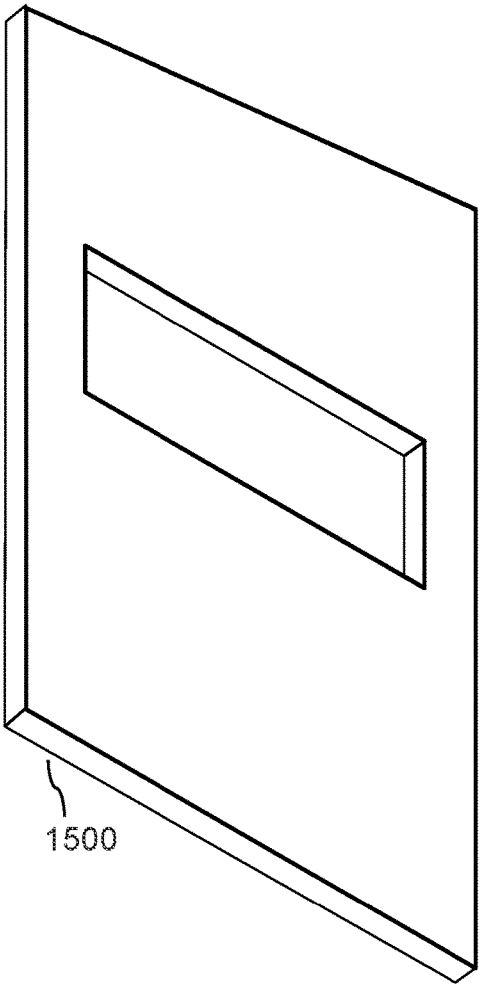
FIG. 15B is a perspective view of an intermediate sloped window wall, according to an embodiment of the invention.
Figure 16A:
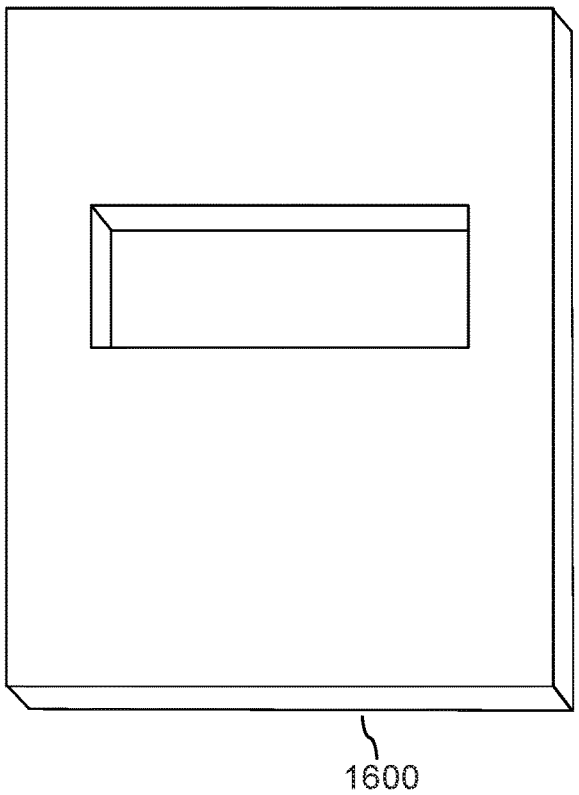
FIG. 16A is a front view of an intermediate tall wall panel, according to an embodiment of the invention.
Figure 16B:
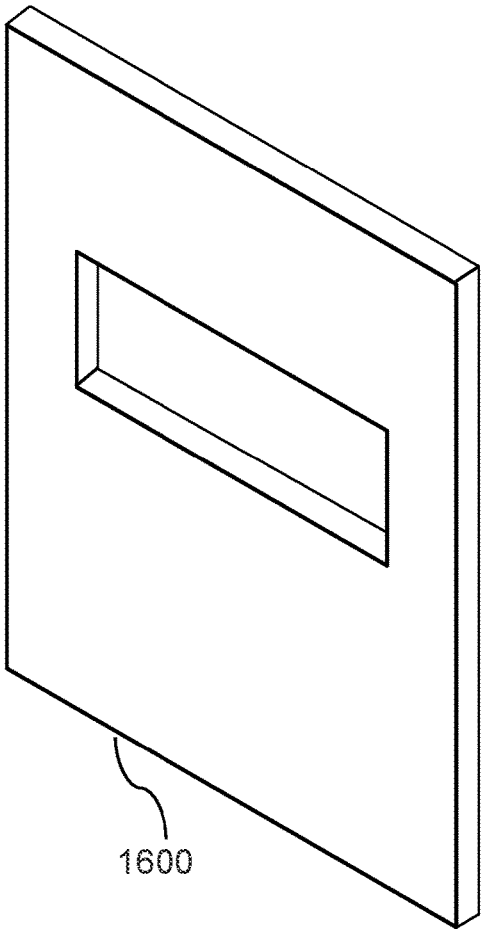
FIG. 16B is a perspective view of an intermediate tall wall panel, according to an embodiment of the invention.
Figure 17A:
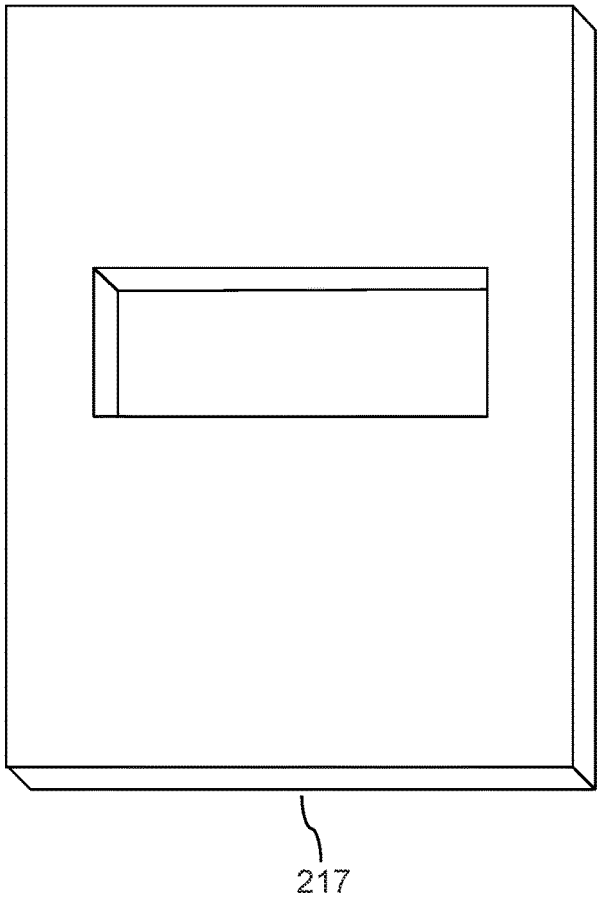
FIG. 17A is a front view of an intermediate short wall, according to an embodiment of the invention.
Figure 17B:
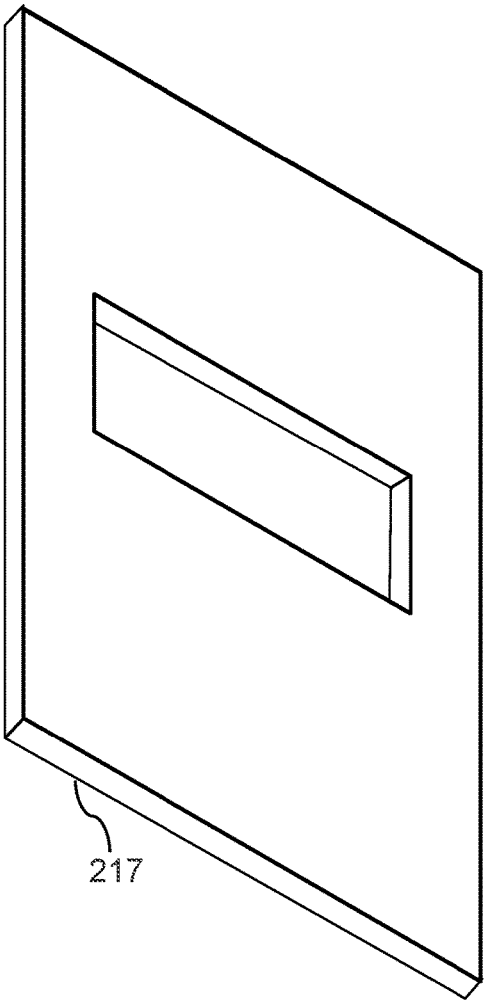
FIG. 17B is a perspective view of an intermediate short wall, according to an embodiment of the invention.
Figure 18A:
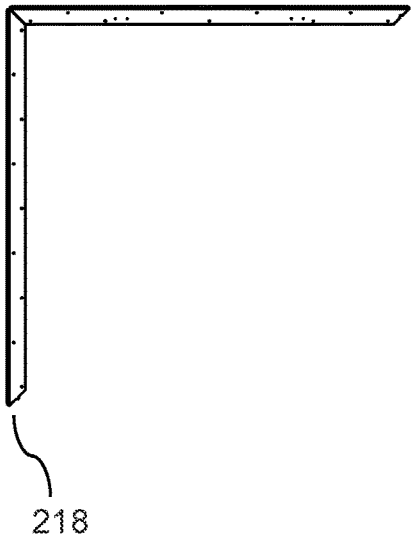
FIG. 18A is a top view of an upper roof angle, according to an embodiment of the invention.
Figure 18B:
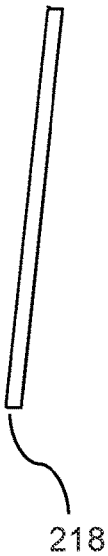
FIG. 18B is a side view of an upper roof angle, according to an embodiment of the invention.
Figure 18C:
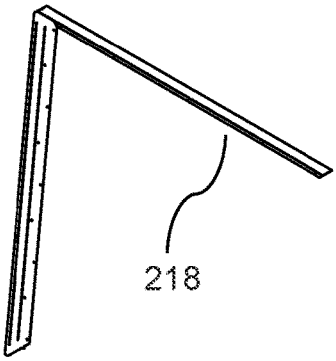
FIG. 18C is a perspective view of an upper roof angle, according to an embodiment of the invention.
Figure 18D:
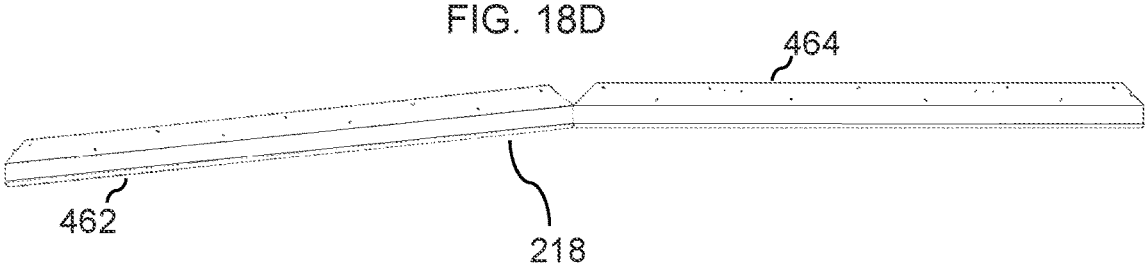
FIG. 18D is a front view of an upper roof angle, according to an embodiment of the invention.
Figure 19A:
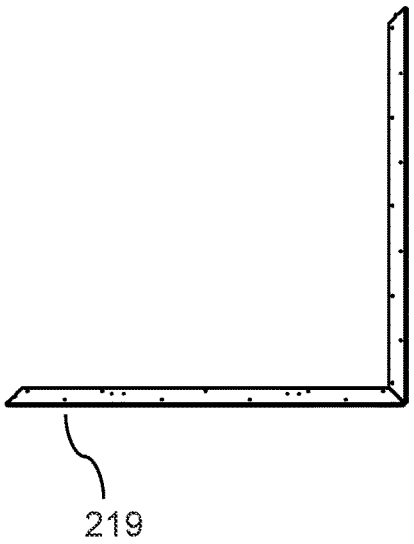
FIG. 19A is a top view of a lower roof angle, according to an embodiment of the invention.
Figure 19B:
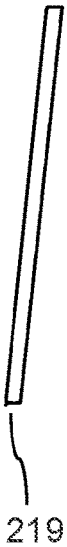
FIG. 19B is a side view of a lower roof angle, according to an embodiment of the invention.
Figure 19C:
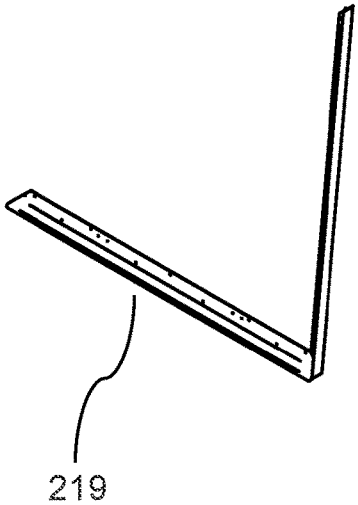
FIG. 19C is a perspective view of a lower roof angle, according to an embodiment of the invention.
Figure 19D:
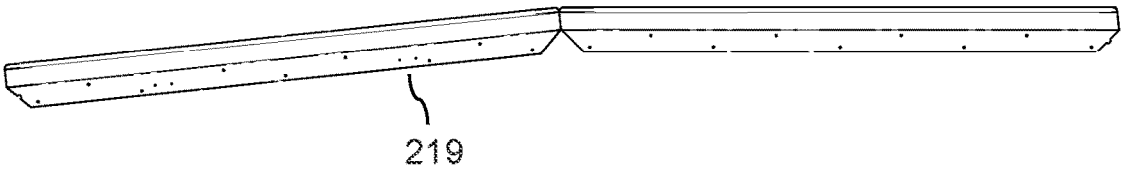
FIG. 19D is a front view of a lower roof angle, according to an embodiment of the invention.
Figure 20A:
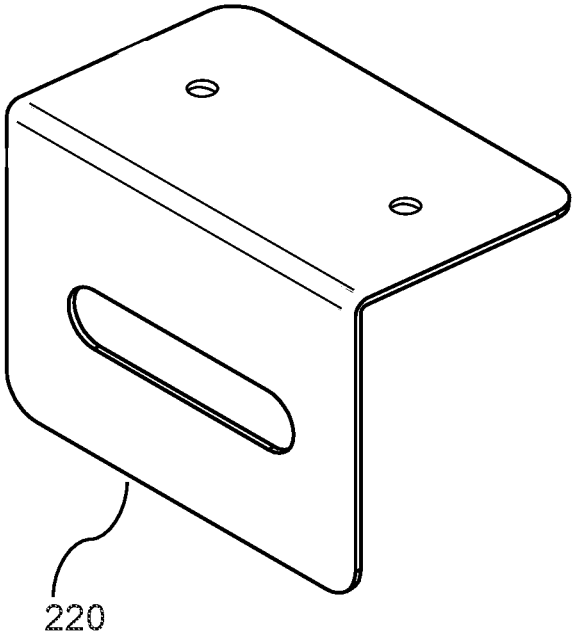
FIG. 20A is a perspective view of a upper roof mounting bracket, according to an embodiment of the invention.
Figure 20B:
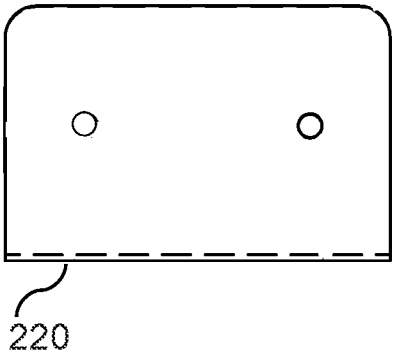
FIG. 20B is a top view of an upper roof mounting bracket, according to an embodiment of the invention.
Figure 20C:
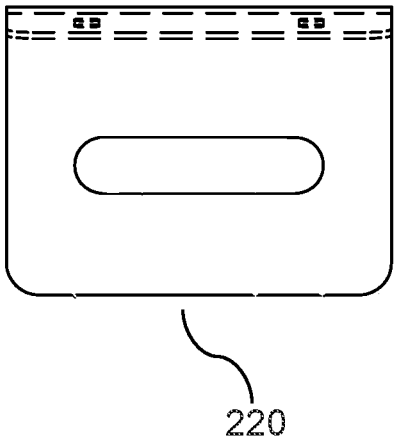
FIG. 20C is a front view of an upper roof mounting bracket, according to an embodiment of the invention.
Figure 20D:
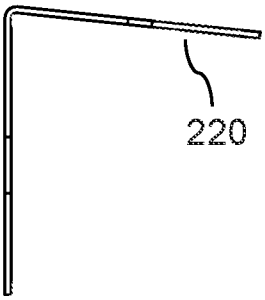
FIG. 20D is a side view of an upper roof mounting bracket, according to an embodiment of the invention.
Figure 21A:
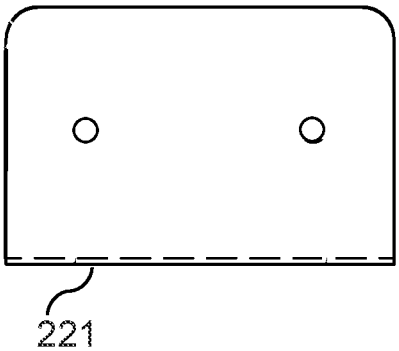
FIG. 21A is a top view of a lower roof mounting bracket, according to an embodiment of the invention.
Figure 21B:
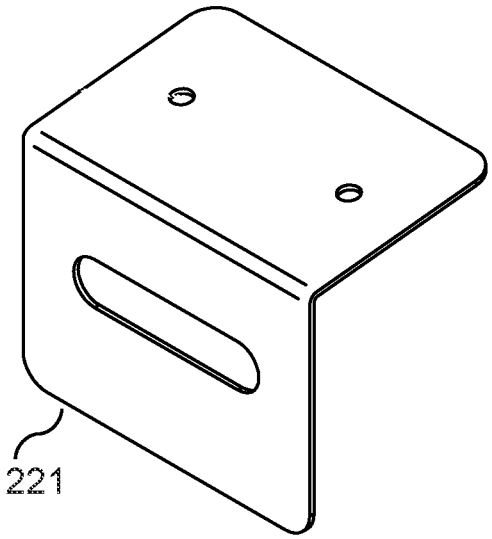
FIG. 21B is a perspective view of a lower roof mounting bracket, according to an embodiment of the invention.
Figure 21C:
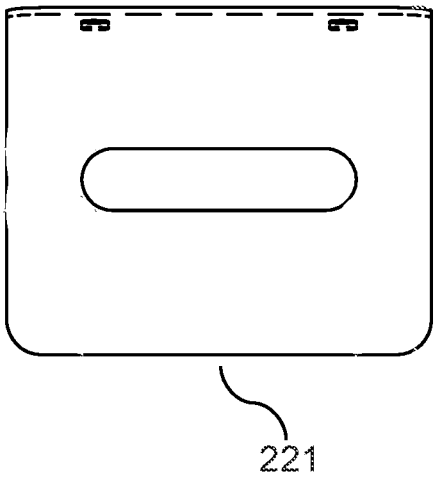
FIG. 21C is a front view of a lower roof mounting bracket, according to an embodiment of the invention.
Figure 21D:
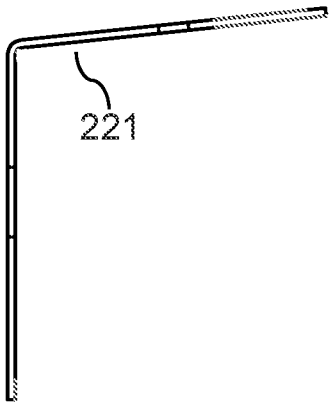
FIG. 21D is a side view of a lower roof mounting bracket, according to an embodiment of the invention.
Figure 22A:
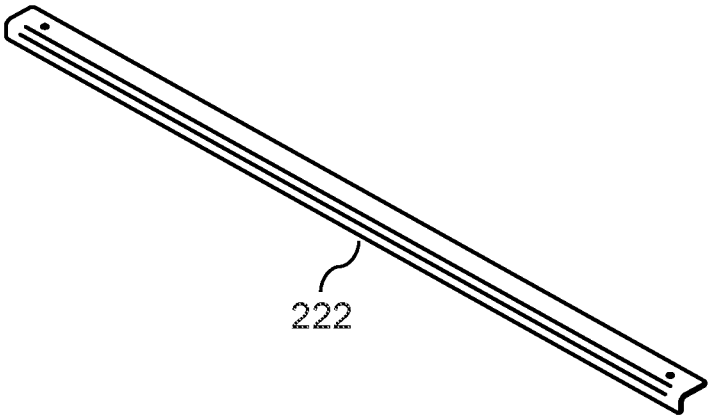
FIG. 22A is a perspective view of a shooting rail, according to an embodiment of the invention.
Figure 22B:
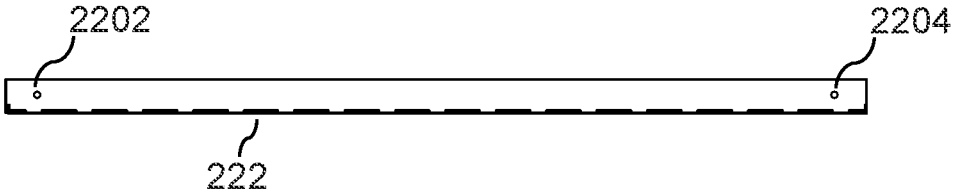
FIG. 22B is a top view of a shooting rail, according to an embodiment of the invnetion.
Figure 22C:
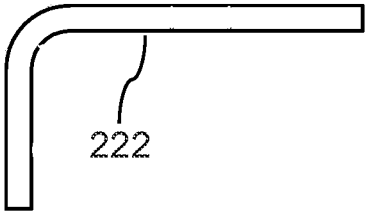
FIG. 22C is a side view of a shooting rail, according to an embodiment of the invention.
Figure 22D:
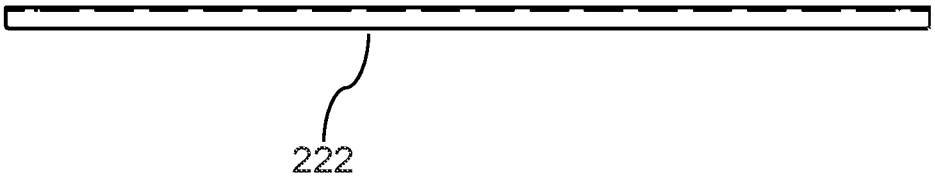
FIG. 22D is a front view of a shooting rail, according to an embodiment of the invention.
Figure 23A:
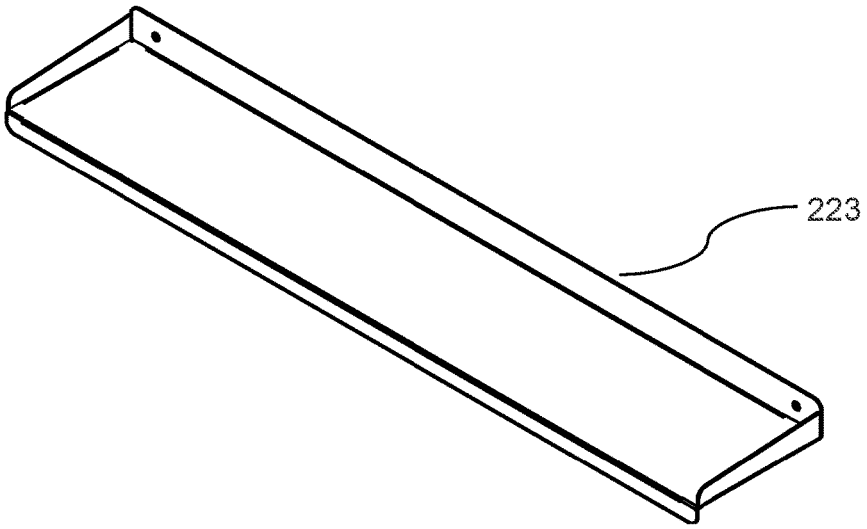
FIG. 23A is a perspective view of an upper shelf, according to an embodiment of the invention.
Figure 23B:
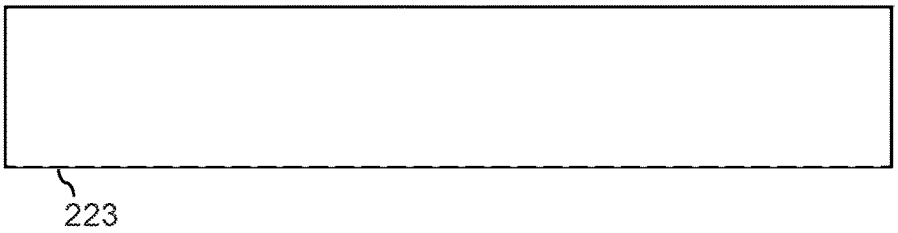
FIG. 23B is a top view of an upper shelf, according to an embodiment of the invention.
Figure 23C:
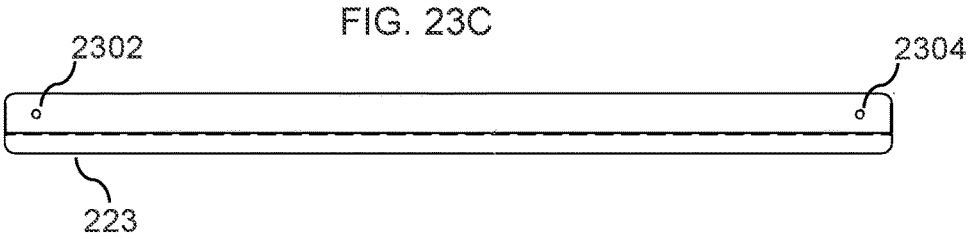
FIG. 23C is a front view of an upper shelf, according to an embodiment of the invention.
Figure 23D:
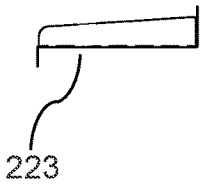
FIG. 23D is a side view of an upper shelf, according to an embodiment of the invention.
Figure 24A:
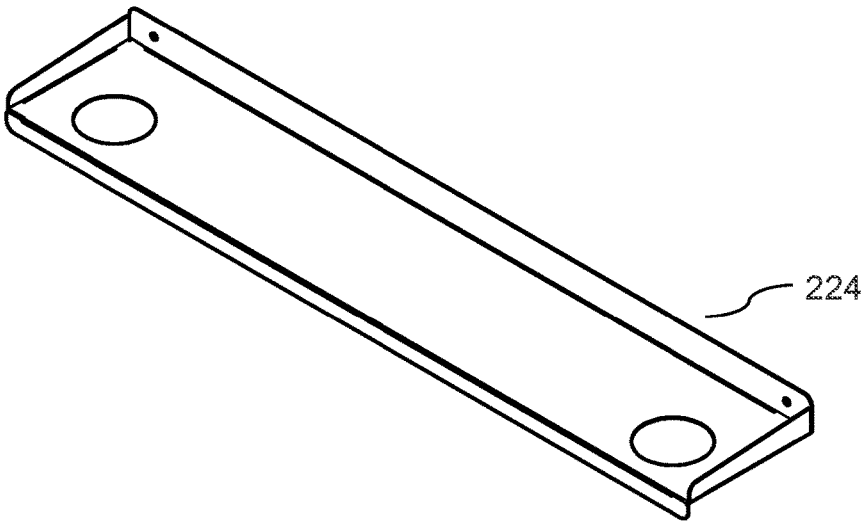
FIG. 24A is a perspective view of a lower shelf, according to an embodiment of the invention.
Figure 24B:
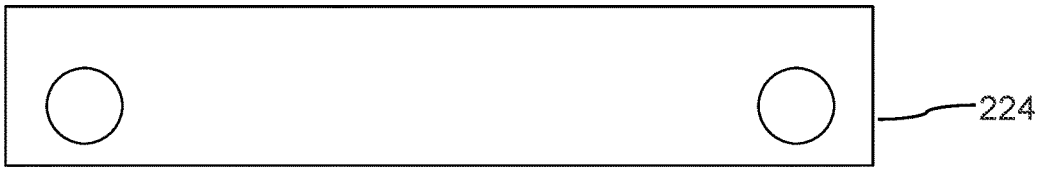
FIG. 24B is a top view of a lower shelf, according to an embodiment of the invention.
Figure 24C:
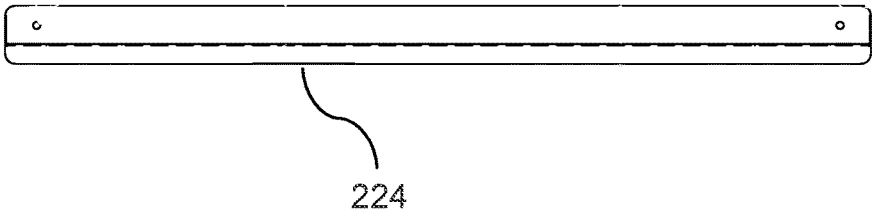
FIG. 24C is a front view of a lower shelf, according to an embodiment of the invention.
Figure 24D:
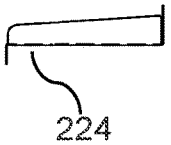
FIG. 24D is a side view of a lower shelf, according to an embodiment of the invention.
Figure 25A:
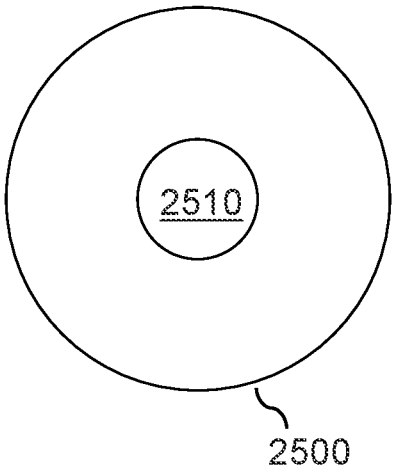
FIG. 25A is a top view of a shooting rail spacer, according to an embodiment of the invention.
Figure 25B:
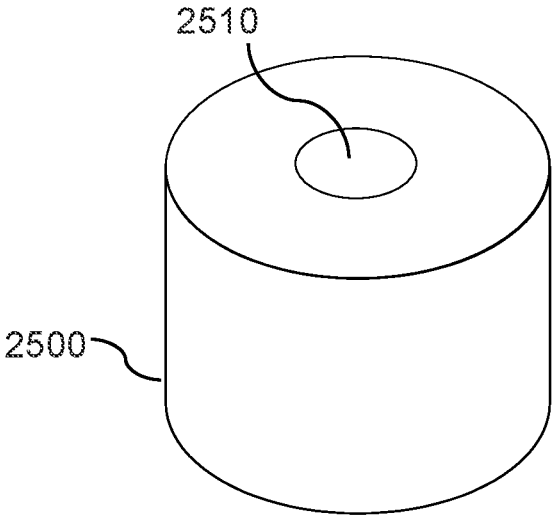
FIG. 25B is a perspective view of a shooting rail spacer, according to an embodiment of the invention.
Figure 25C:
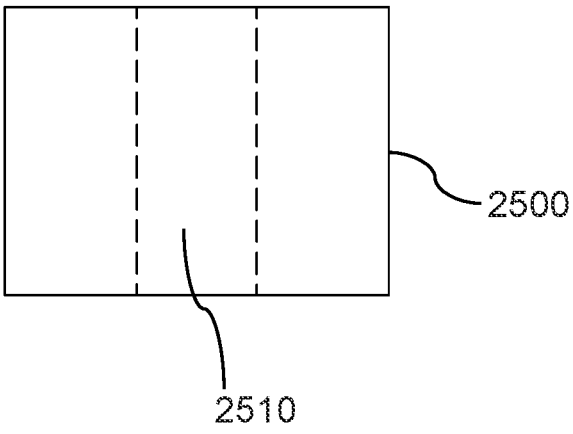
FIG. 25C is a front view of a shooting rail spacer, according to an embodiment of the invention.
Figure 26A:
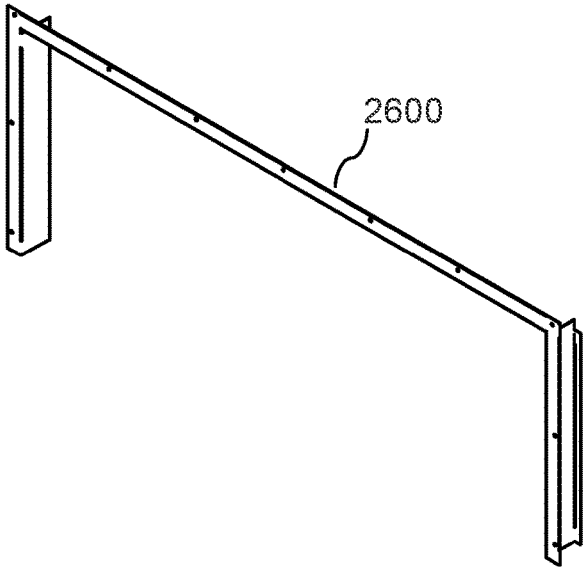
FIG. 26A is a perspective view of a window jamb header trim, according to an embodiment of the invention.
Figure 26B:
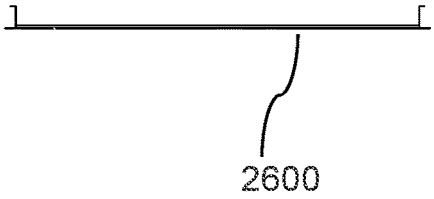
FIG. 26B is a top view of a window jamb header trim, according to an embodiment of the invention.
Figure 26C:
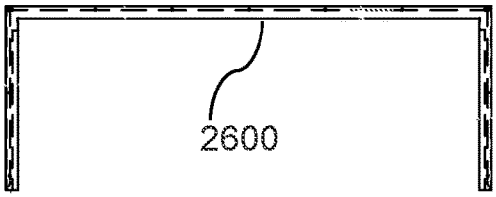
FIG. 26C is a front view of a window jamb header trim, according to an embodiment of the invention.
Figure 26D:
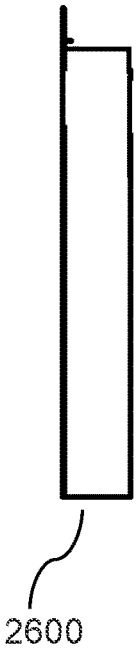
FIG. 26D is a side view of a window jamb header trim, according to an embodiment of the invention.
Figure 27A:
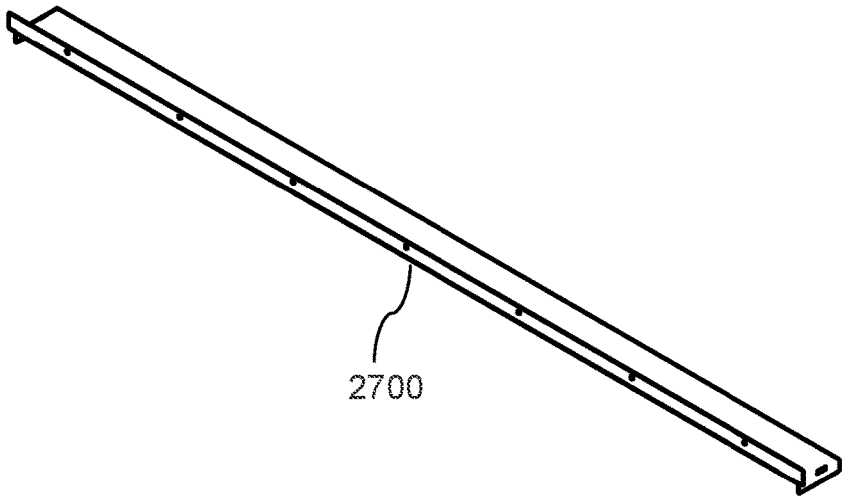
FIG. 27A is a perspective view of a window header trim, according to an embodiment of the invention.
Figure 27B:
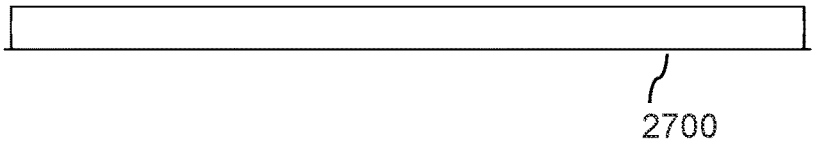
FIG. 27B is a top view of a window header trim, according to an embodiment of the invention.
Figure 27C:
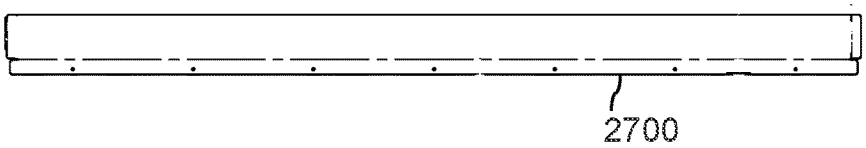
FIG. 27C is a top view of a window header trim prior to being folded, according to an embodiment of the invention.
Figure 27D:
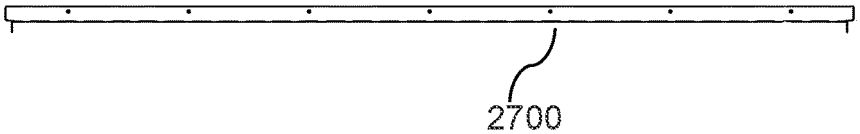
FIG. 27D is a front view of a window header trim, according to an embodiment of the invention.
Figure 27E:
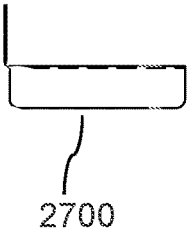
FIG. 27E is a side view of a window header trim, according to an embodiment of the invention.
Figure 28A:
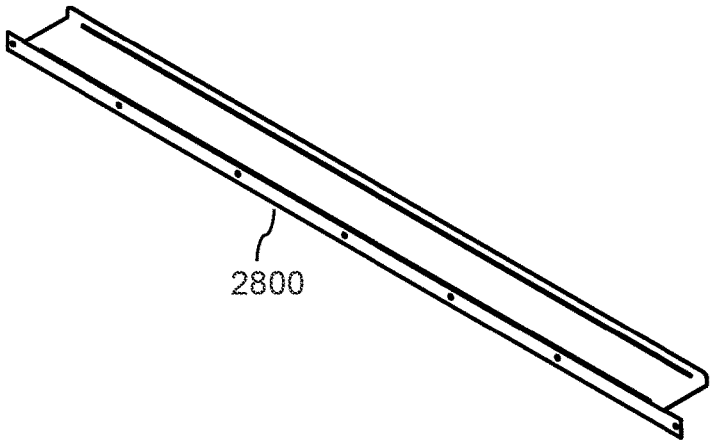
FIG. 28A is a perspective view of a windowsill, according to an embodiment of the invention.
Figure 28B:
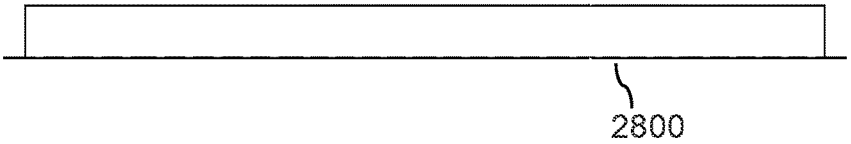
FIG. 28B is a top view of a windowsill, according to an embodiment of the invention.
Figure 28C:
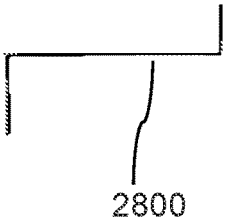
FIG. 28C is a side view of a windowsill.
Figure 28D:
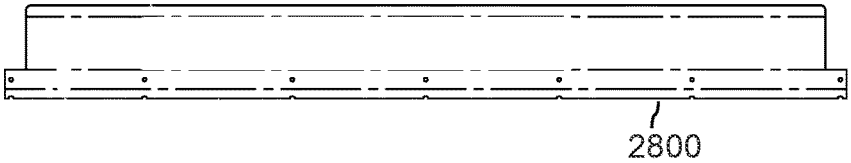
FIG. 28D is a top view of a windowsill prior to being folded, according to an embodiment of the invention.
Figure 28E:
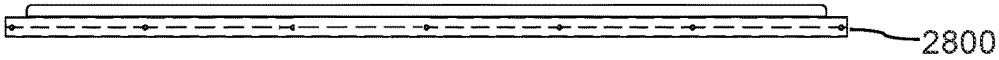
FIG. 28E is a front view of a windowsill, according to an embodiment of the invention.

In a related embodiment, as shown in FIGS. 4A-4F, a process of mounting the modular building system 100 can include:

a) Mounting the base mounting structure 410 on the platform 180 with a floor plate 450 positioned inside a bottom of the base mounting structure 410, such that the floor plate 450 is resting on and secured to the platform 180; and preparing a left receiving wall assembly 230 for mounting on a left side of the base mounting structure 410, as shown in FIG. 4A;

b) Mounting the left receiving wall assembly 230 on a left side of the base mounting structure 410, as shown in FIG. 4B;

c) Mounting the rear wall assembly 258 on a rear side of the base mounting structure 410, as shown in FIG. 4C;

d) Mounting the right receiving wall assembly 440 on a right side of the base mounting structure 410, as shown in FIG. 4D;

e) Mounting the front wall assembly 256 on a front side of the base mounting structure 410, as shown in FIG. 4E; and f) Mounting the roof assembly 460 on a top of the left receiving wall assembly 230, the rear wall assembly 258, the right receiving wall assembly 440, and the front wall assembly 256, as shown in FIG. 4F, thereby producing an assembled modular building system 100, as shown in FIG. 1.

Figure 2A:
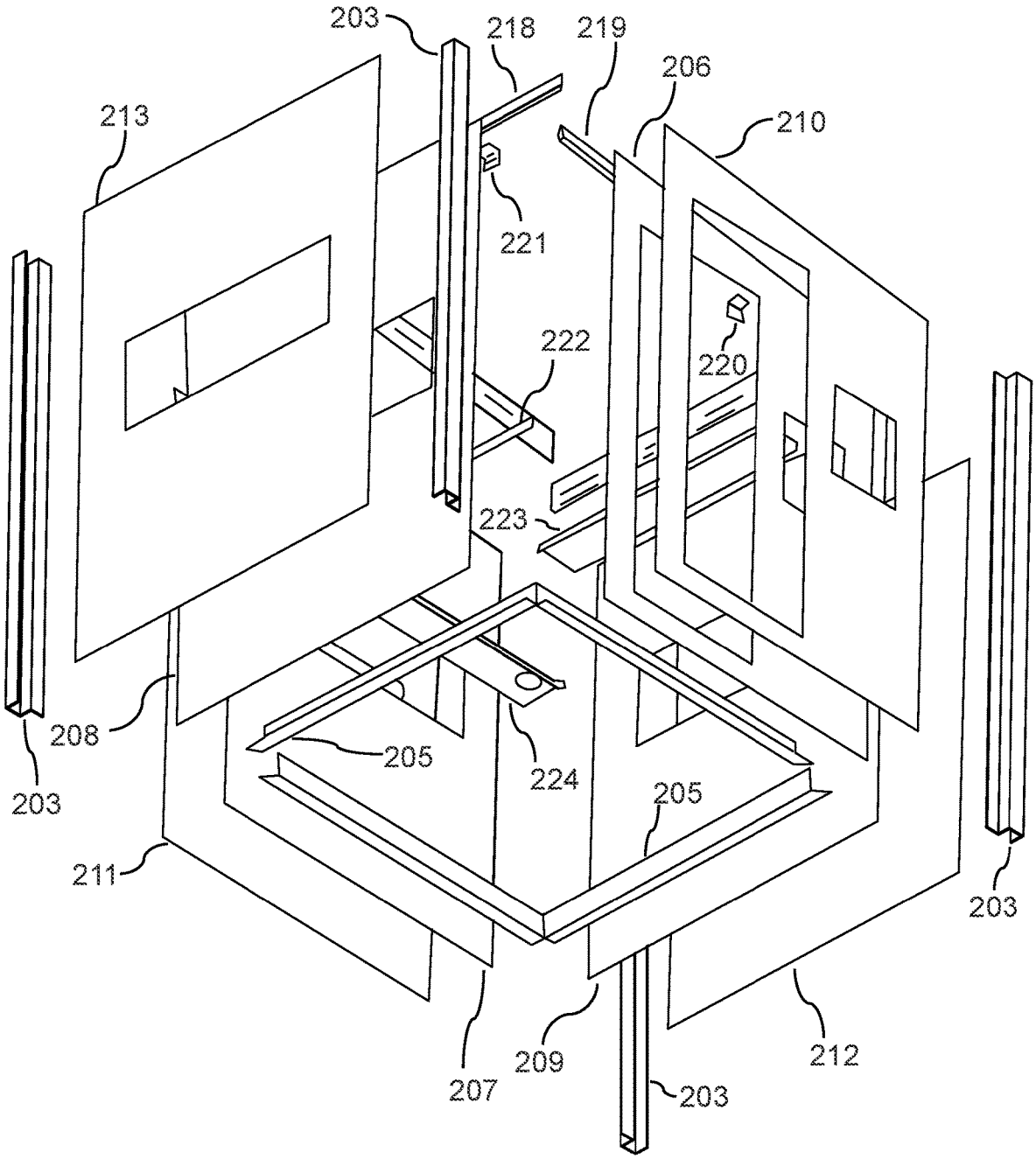
FIG. 2A is an exploded bottom perspective view of selected parts of a modular building system, according to an embodiment of the invention.
Figure 2B:
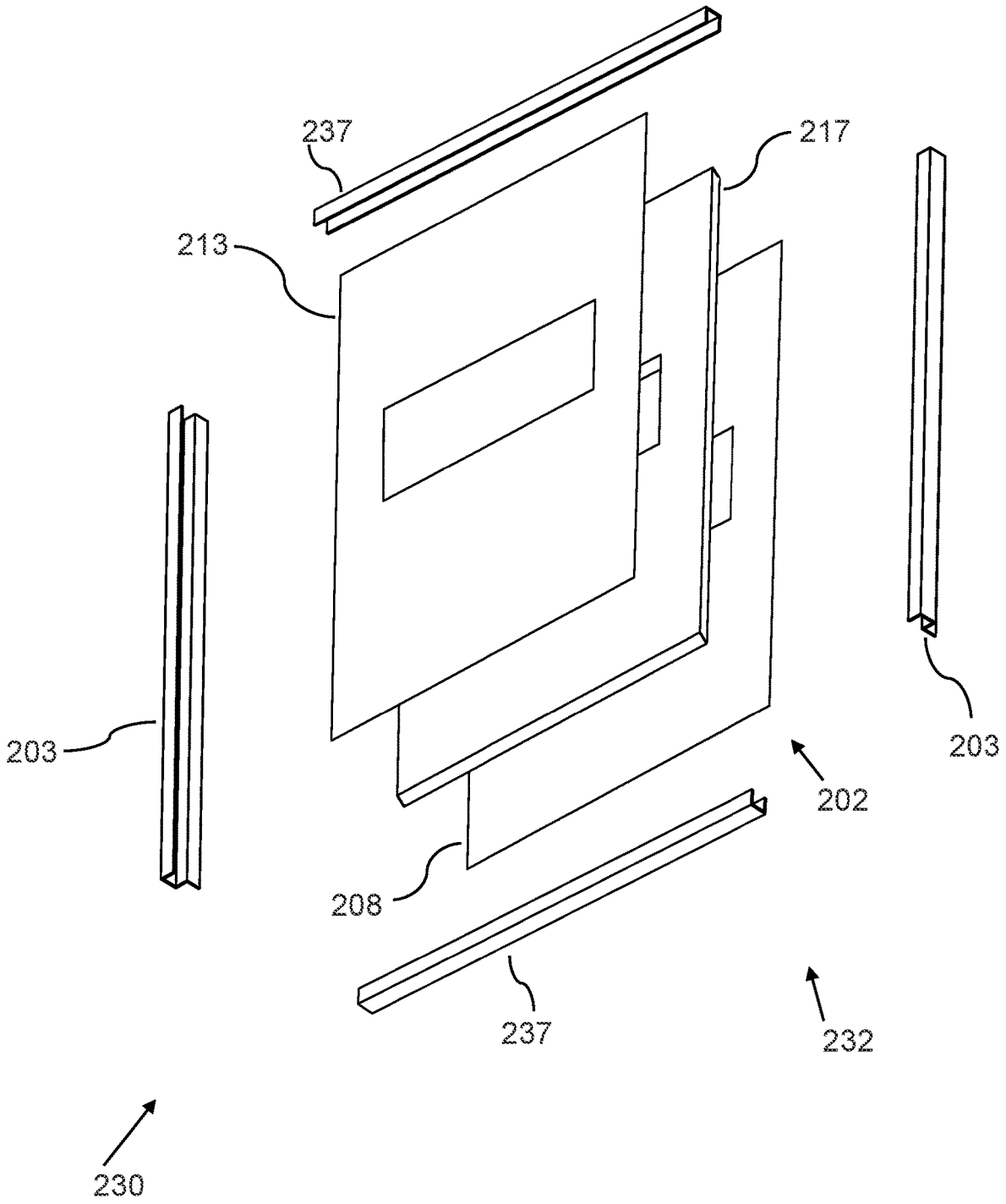
FIG. 2B is an exploded bottom perspective view of a wall assembly with a modular side bracket, according to an embodiment of the invention.
Figure 2C:
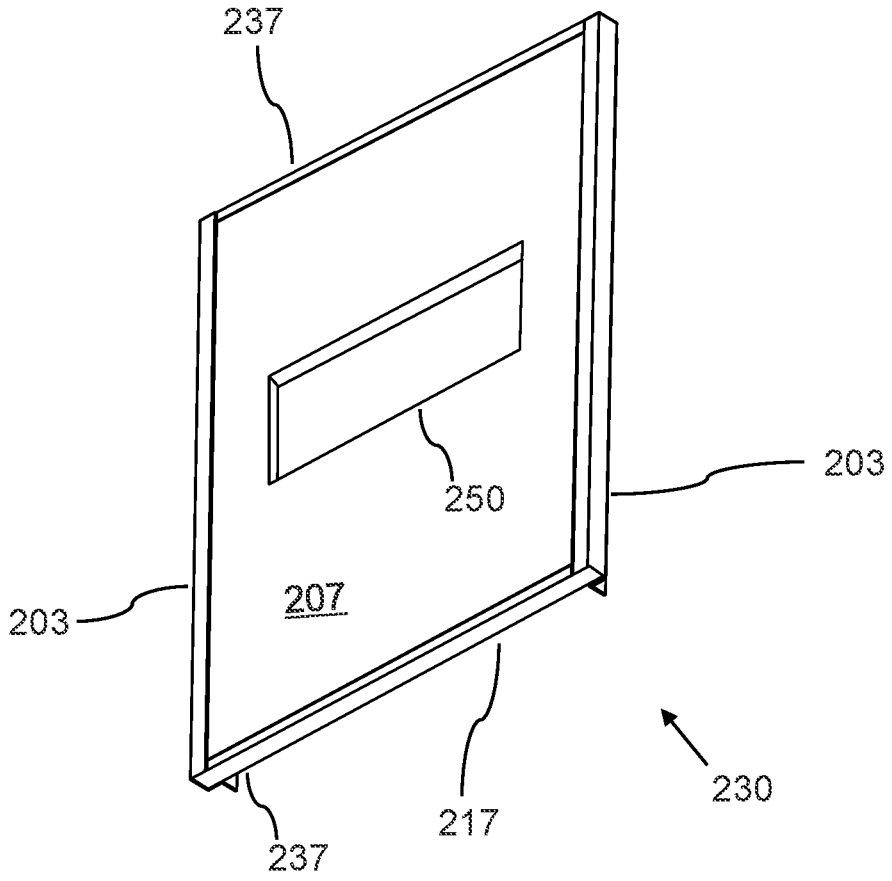
FIG. 2C is a bottom perspective view of a wall assembly with a modular side bracket attached, according to an embodiment of the invention.
Figure 2D:
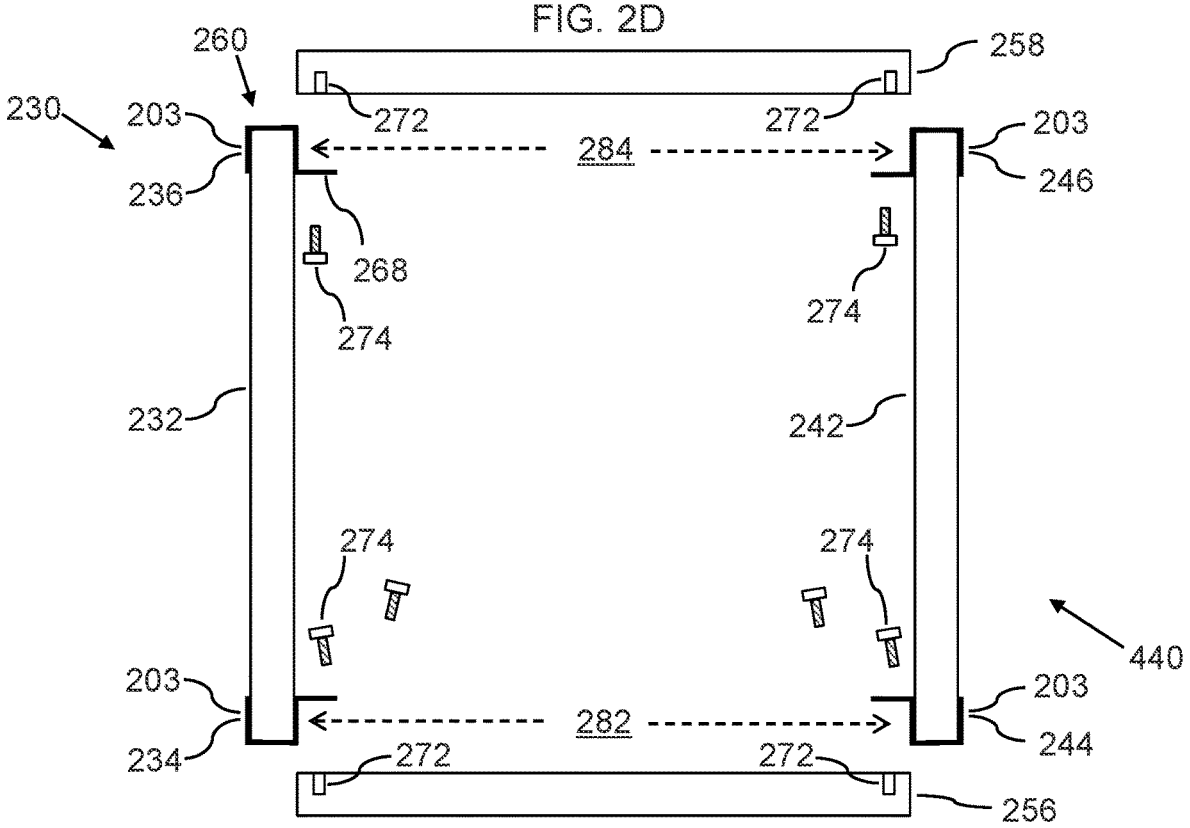
FIG. 2D is a top view of parts of a modular building system with corner bracket attached to side wall panels, with front and rear wall panels detached, according to an embodiment of the invention.
Figure 2E:
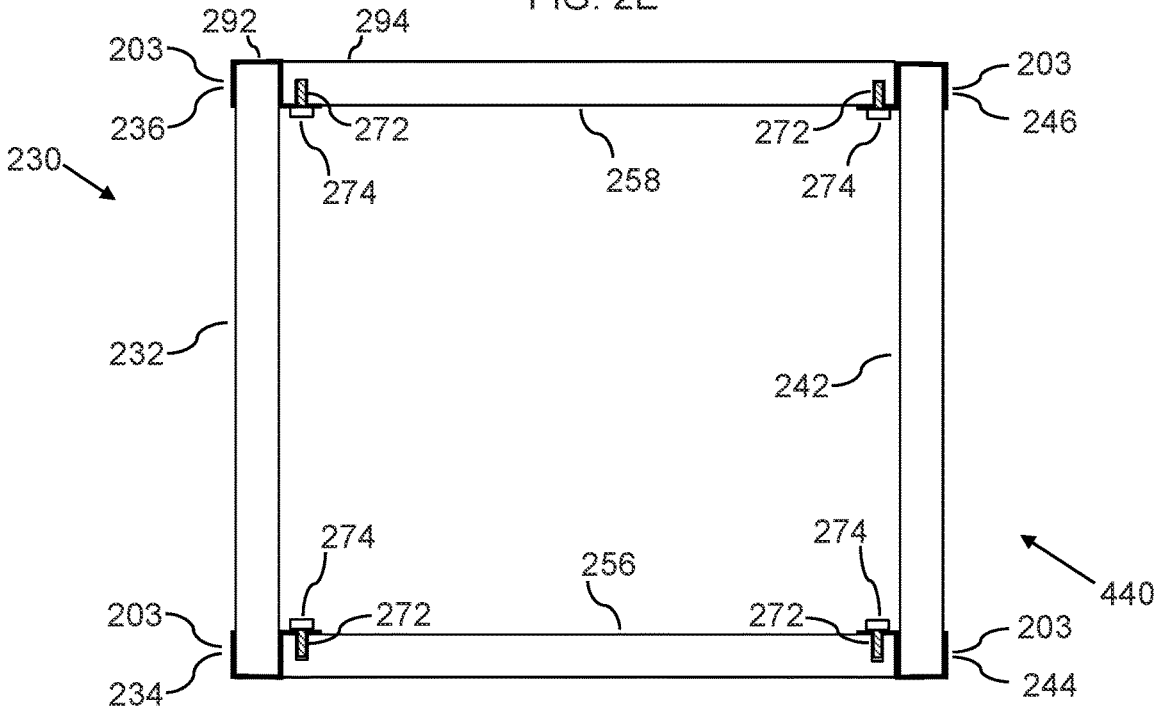
FIG. 2E is a top view of parts of a modular building system with corner brackets attached to side wall panels, with front and rear wall panels mounted between corner brackets, according to an embodiment of the invention.

In a related embodiment, as shown in FIGS. 2D, 2E, and 4C:

a) each of the left receiving wall assembly 230, the rear wall assembly 258, the right receiving wall assembly 440, and the front wall assembly 256 can include (i.e., be configured with):

i. a first plurality of screw apertures 272 along inside side edges of the corresponding wall assembly 230, 256, 258, 440; and b) the modular building assembly 102 can further include:

i. a first plurality of screws 274;

such that each corresponding screw 274 is screwed through a corresponding corner bracket 203 (via a corner aperture 275) into a corresponding screw aperture 272, which can be a threaded screw aperture 272, from an interior/inside of the modular building assembly 102;

whereby a corresponding wall assembly 230, 256, 258, 440 is secured to the corresponding corner bracket 203;

whereby the modular building assembly 102 can be tightened from an interior/inside of the modular building assembly 102, by one person.

In a related embodiment, as shown in FIGS. 4A and 4B:

a) each of the left receiving wall assembly 230, the rear wall assembly 258, the right receiving wall assembly 440, and the front wall assembly 256 can include (i.e., be configured with):

i. a second plurality of screw apertures 486 along inside bottom edges of the corresponding wall assembly 230, 256, 258, 440; and b) the modular building assembly 102 can further include:

i. a second plurality of screws 488;

such that each corresponding screw 488 is screwed through a corresponding base angle bracket 205 (via a base aperture 487) into a corresponding screw aperture 486, which can be a threaded screw aperture 486, from an interior/inside of the modular building assembly 102;

whereby a corresponding wall assembly 230, 256, 258, 440 is secured to the corresponding base angle bracket 205;

whereby the modular building assembly 102 can be tightened from an interior/inside of the modular building assembly 102, by one person.

In a related embodiment, the first and second base angle brackets 205 can be welded together, and the base mounting structure 410 can be welded to the platform 180.

In a related embodiment, FIG. 2A, shows an exploded view of selected parts of the modular building system 100.

In another related embodiment, as shown in FIGS. 2B, 2C, 2D, and 2E, the left and right primary wall assembly 232, 242, and the front and rear wall assemblies 256, 258 can each be configured as a sandwiched construction, which can include:

a) a panel assembly 202, which can include i. an outside wall panel 210, 211, 212, 213, as shown in FIGS. 10A-10B, 11A-11B, 12A-12B, and 13A-13B, which can be a water-resistant board, such as a composite layered board, for example made of glass fiber, carbon fiber, or composites thereof;

ii. an intermediate panel 1400, 1500, 1600, 217, as shown in FIGS. 14A-14B, 15A-15B, 16A-16B, 2B, and 17A-17B, which can be made from a water-resistant foam material, such as a hard closed-cell polyurethane foam; and iii. an inside wall panel 206, 207, 208, 209, as shown in FIGS. 6A-6B, 7A-7B, 8A-8B, and 9A-9B, which can be a water-resistant board, such as a composite layered board, for example made of glass fiber, carbon fiber, or composites thereof;

wherein the intermediate panel 217 is positioned (i.e., sandwiched) between the outside and inside wall panels 213, 208, as shown in FIG. 2B;

b) top and bottom u-shaped brackets 237, as shown in FIGS. 30A, 30B, 30C, 3D, and 3E;

wherein the top and bottom u-shaped brackets 237, are positioned on (i.e., slid in place over) respectively a top and a bottom of the panel assembly 202.

In various related embodiments, as shown in FIGS. 1, 2D-2E, 4A-4F, the left and right primary wall assembly 232, 242, and the front and rear wall assemblies 256, 258 can each be configured with one or more cutout apertures to accommodate a door including a door member and door fittings; and/or a window assembly, including at least one window member and window fittings.

In another related embodiment, the roof assembly 460 on a top of the left receiving wall assembly 230, the rear wall assembly 258, the right receiving wall assembly 440, and the front wall assembly 256, using upper roof mounting brackets 220 and lower roof mounting brackets 221, shown in FIGS. 20A, 20B, 20C, 20D and 21A, 21B, 21C, 21D.

In another related embodiment, FIG. 2D shows a top view of parts of a modular building system 100 with corner brackets 203 attached to side wall assemblies 232, 242, with front and rear wall assemblies 256, 258 detached. FIG. 2E shows the front and rear wall assemblies 256, 258 mounted in respectively the front and rear mounting opening 282, 284.

In a related embodiment, as shown in FIGS. 34A-34F, the modular building assembly 102 can further include at least one slidable window assembly 470, which can be mounted in a window aperture 250 of a wall assembly 232, 242, 256, 258.

In a further related embodiment, as shown in FIGS. 4A, 34C, 34D, and 34E, the at least one slidable window assembly 470 can include:

a) a window piece 476;

b) a left window groove assembly 472, 3300, which comprises a left groove 3473, wherein the left window groove assembly is mounted on a left side of the window aperture 250; and c) a right window groove assembly 474, 3300, which comprises a right groove 3475, wherein the left window groove assembly is mounted on a right side of the window aperture 250;

wherein a left side of the window piece 476 can be slidably mounted inside the left groove 3473; and wherein a right side of the window piece 476 can be slidably mounted inside the right groove 3473;

such that the window piece 476 is vertically slidably 479 mounted between the left window groove assembly 472 and the right window groove assembly 474.

Figure 33A:
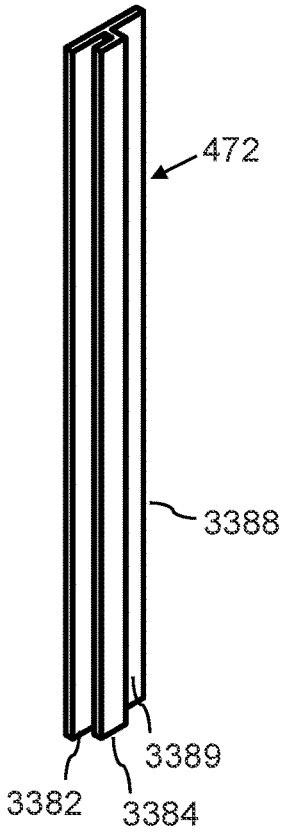
FIG. 33A is a first perspective view of a window groove assembly, according to an embodiment of the invention.
Figure 33B:
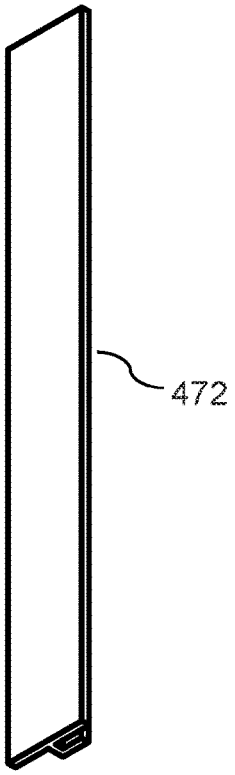
FIG. 33B is a second perspective view of a window groove assembly, according to an embodiment of the invention.
Figure 33D:
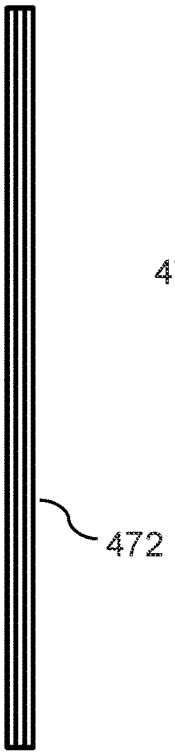
FIG. 33D is a side view of a window groove assembly, according to an embodiment of the invention.
Figure 33E:
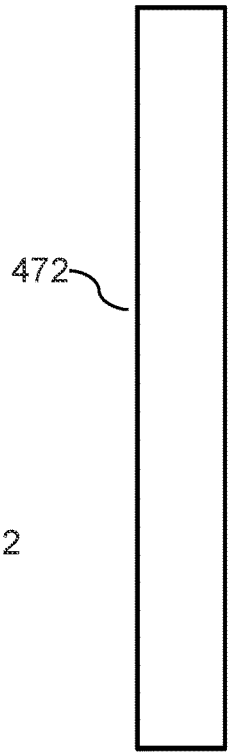
FIG. 33E is a rear view of a window groove assembly, according to an embodiment of the invention.
Figure 33C:
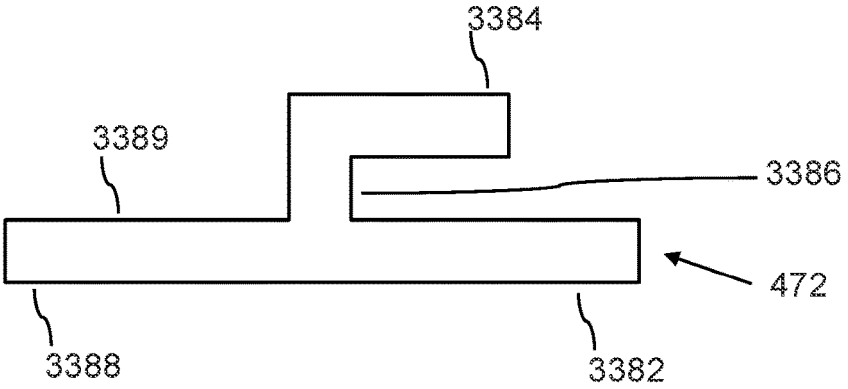
FIG. 33C is a top view of a window groove assembly, according to an embodiment of the invention.
Figure 34A:
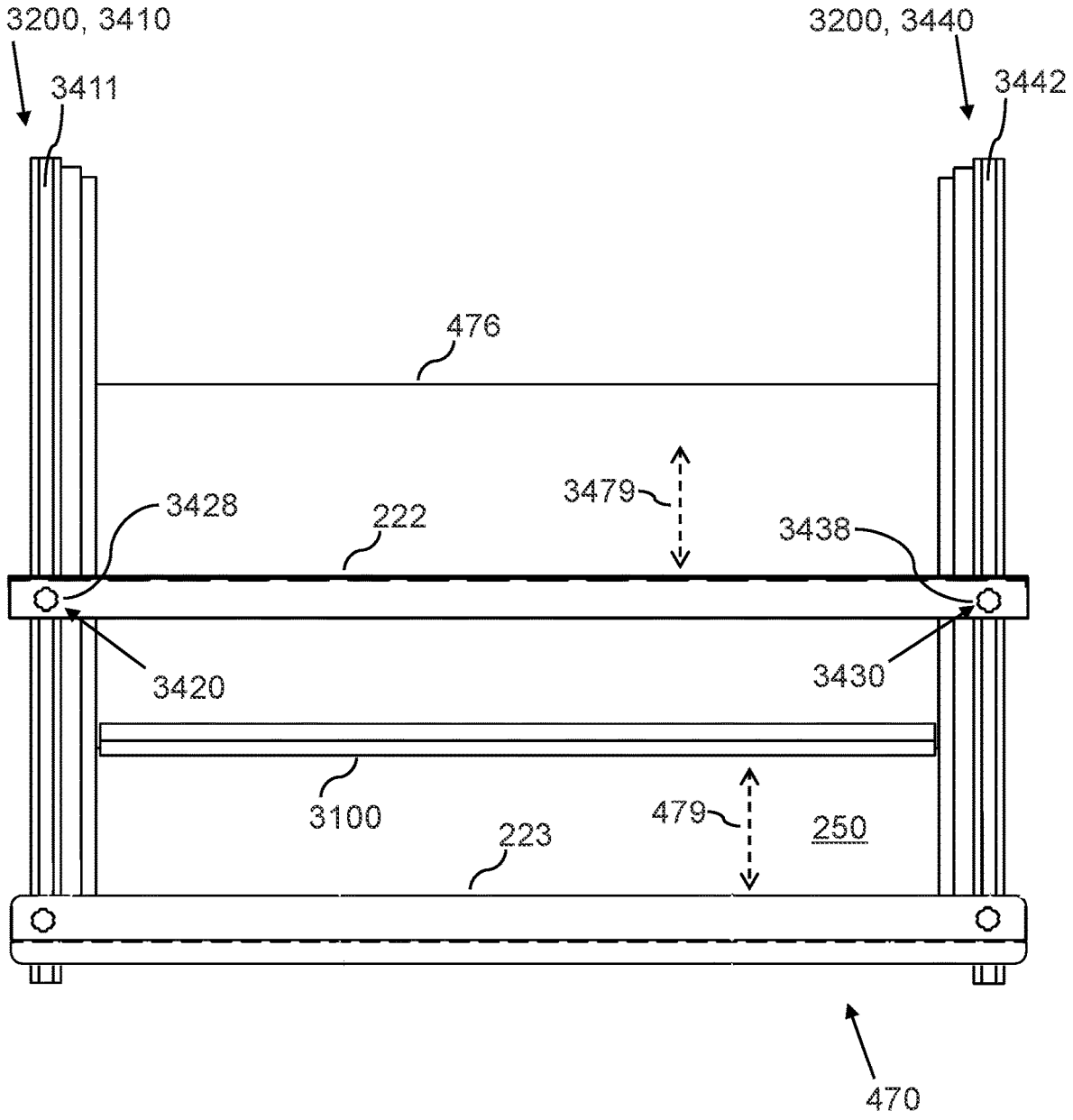
FIG. 34A is a front view of a slidable window assembly, according to an embodiment of the invention.
Figure 34B:
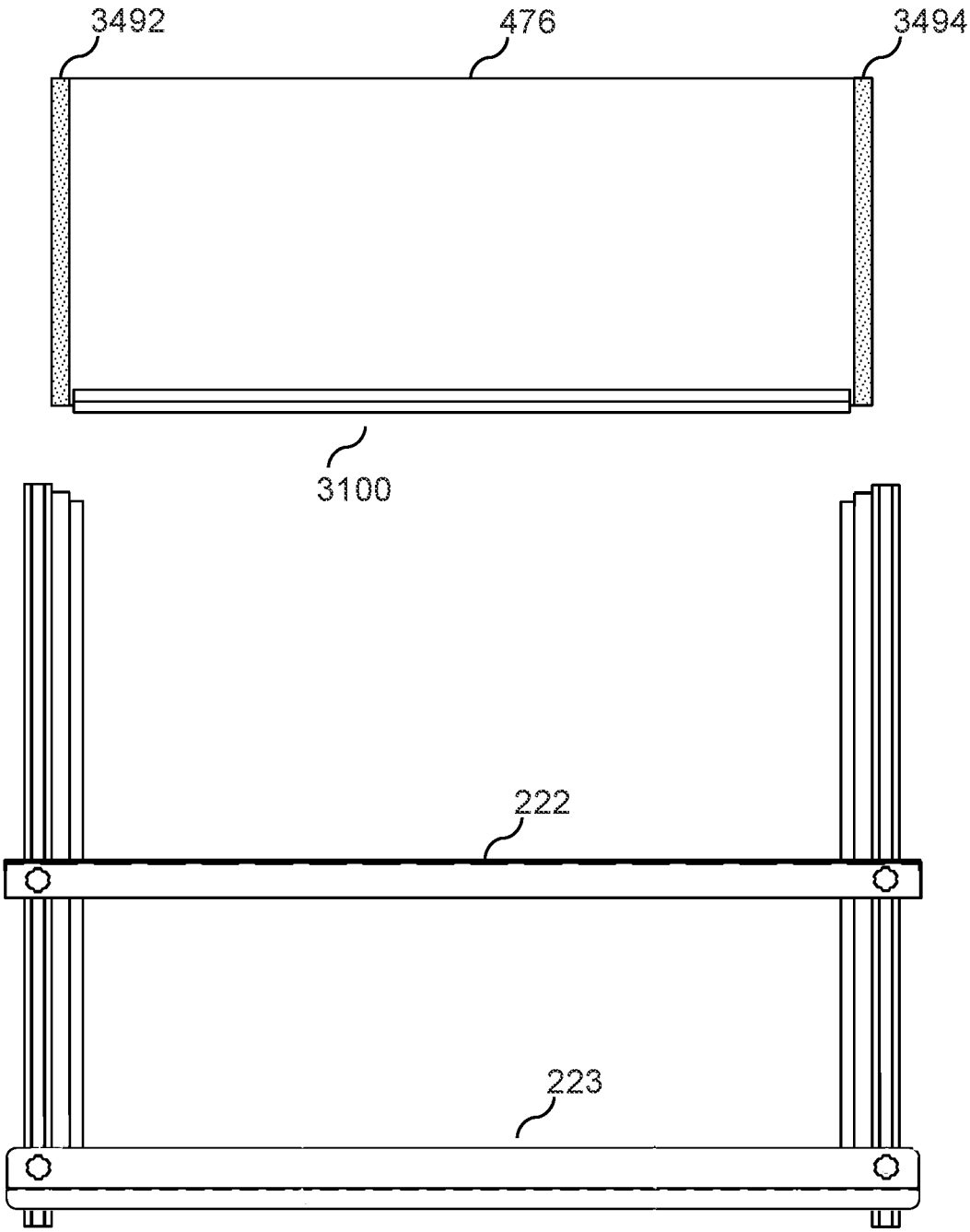
FIG. 34B is a front view of a slidable window assembly with a window detached, according to an embodiment of the invention.
Figure 34C:
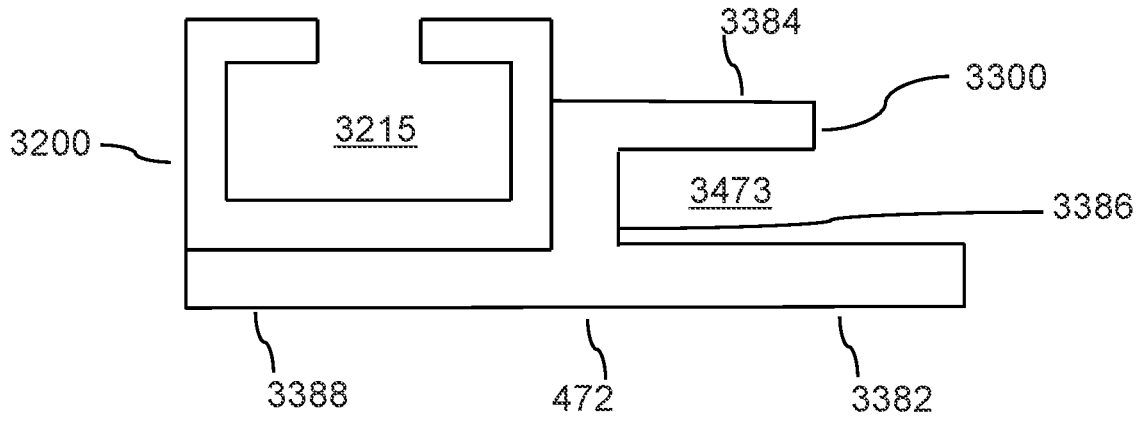
FIG. 34C is a bottom view of a left window groove assembly with an attached left window rail, according to an embodiment of the invention.
Figure 34D:
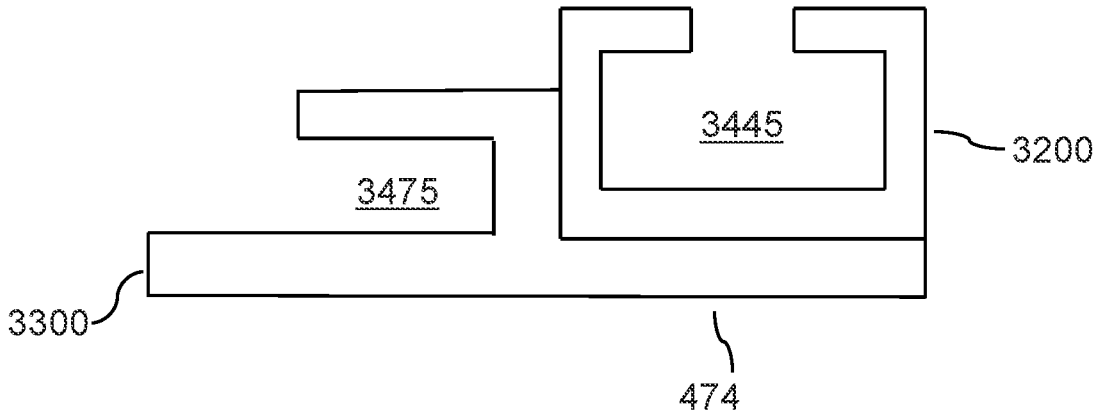
FIG. 34D is a bottom view of a right window groove assembly with an attached right window rail, according to an embodiment of the invention.

In a related embodiment, as shown in FIGS. 33C and 34C, each of the left window groove assembly 472 and the right window groove assembly 474 can further include:

a) an outside vertical groove flange 3382;

b) an inside vertical groove flange 3384;

c) a vertical groove bottom 3386, which is connected along and between inner ends of the outside vertical groove flange 3382 and the inside vertical groove flange 3384; and d) a rear support flange 3388, which is connected along an outside end of the vertical groove bottom 3386, such that the rear support flange 3388 is parallel with and a continuation of (i.e., in the same plane as) the outside vertical groove flange 3382.

Figure 32A:
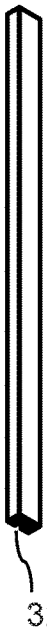
FIG. 32A is a first perspective view of a window rail, according to an embodiment of the invention.
Figure 32B:
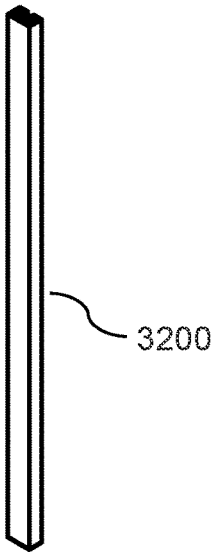
FIG. 32B is a second perspective view of a window rail, according to an embodiment of the invention.
Figure 32C:
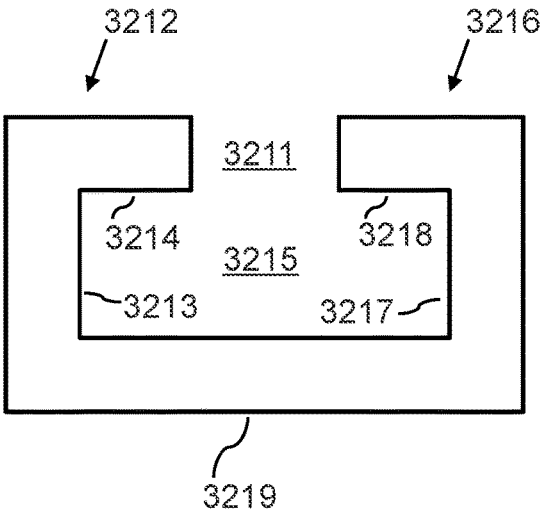
FIG. 32C is a top view of a window rail, according to an embodiment of the invention.
Figure 32D:
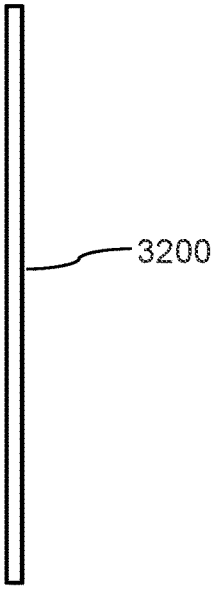
FIG. 32D is a side view of a window rail, according to an embodiment of the invention.
Figure 32E:
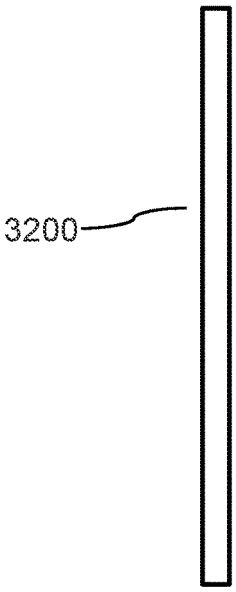
FIG. 32E is a rear view of a window rail, according to an embodiment of the invention.

In a further related embodiment, as shown in FIGS. 32C, 34A and 34B, the at least one slidable window assembly 470 can further include:

a) a left vertical rail 3200, 3410, which comprises a left elongated rail slit 3211, 3411 which provides access to a left elongated rail interior 3215; and b) a right vertical rail 3200, 3440, which comprises a right elongated rail slit 3211, 3442 which provides access to a right elongated rail interior 3445;

wherein the left vertical rail 3410 and the right vertical rail 3440 are mounted on respectively left and right sides of the window aperture 250;

such that the left vertical rail 3410 is connected to the left window groove assembly 472, along a left inner surface 3389 of a left rear support flange 3388 of the left window groove assembly 472;

such that the right vertical rail 3440 is connected to the right window groove assembly 474, along a right inner surface 3389 of a right rear support flange 3388 of the right window groove assembly 474;

such that the at least one slidable window assembly 470 can be configured to enable at least one horizontal elongated object assembly 222, 223 to be vertically slidably and lockably connected between the left vertical rail 3410 and the right vertical rail 3440.

In a yet further related embodiment, as shown in FIG. 32C, the left vertical rail 3410 and the right vertical rail 3440 can each further include:

a) a first L-shaped side flange 3212, including a first side portion 3213 and a first inward protruding portion 3214;

b) a second L-shaped side flange 3216, including a second side portion 3217 and a second inward protruding portion 3218; and c) an elongated rail bottom 3219, such that inner ends of the first side portion 3213 and the second side portion 3217 are connected along respectively first and second sides of the elongated rail bottom 3219;

such that the first inward protruding portion 3214 and the second inward protruding portion 3218 are opposedly oriented;

such that a corresponding elongated rail slit 3211, 3442 is formed between the first inward protruding portion 3214 and the second inward protruding portion 3218.

Figure 34E:
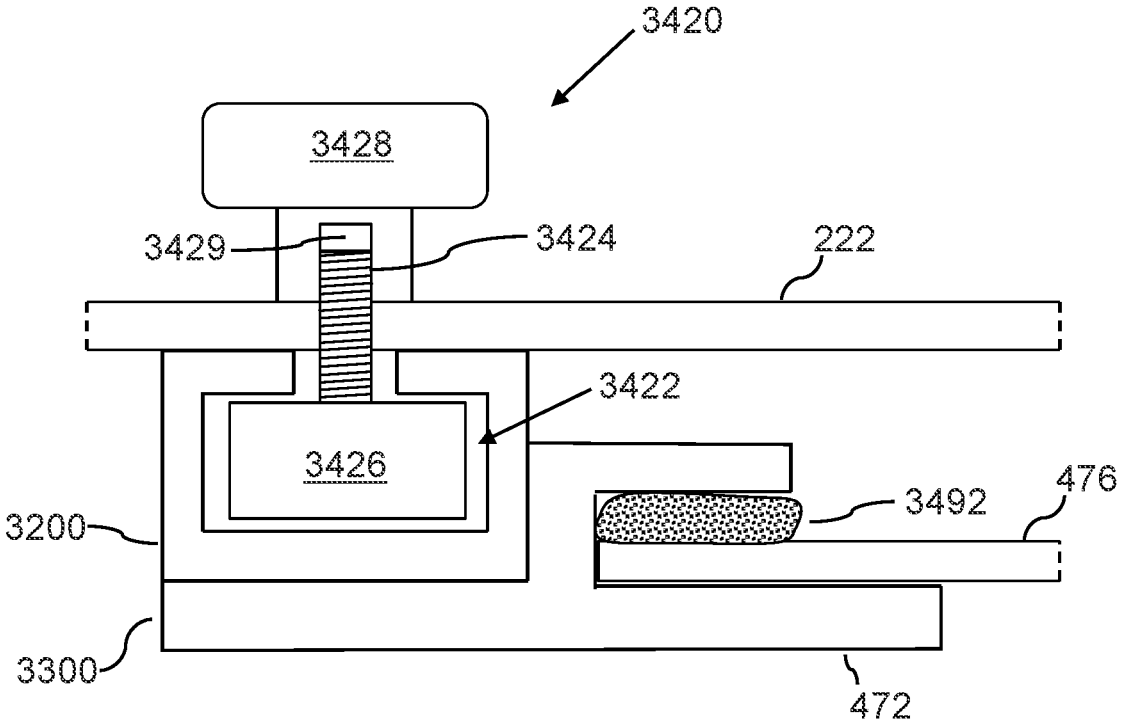
FIG. 34E is a top view of part of a slidable window assembly with a left slidable screw assembly, according to an embodiment of the invention.
Figure 34F:
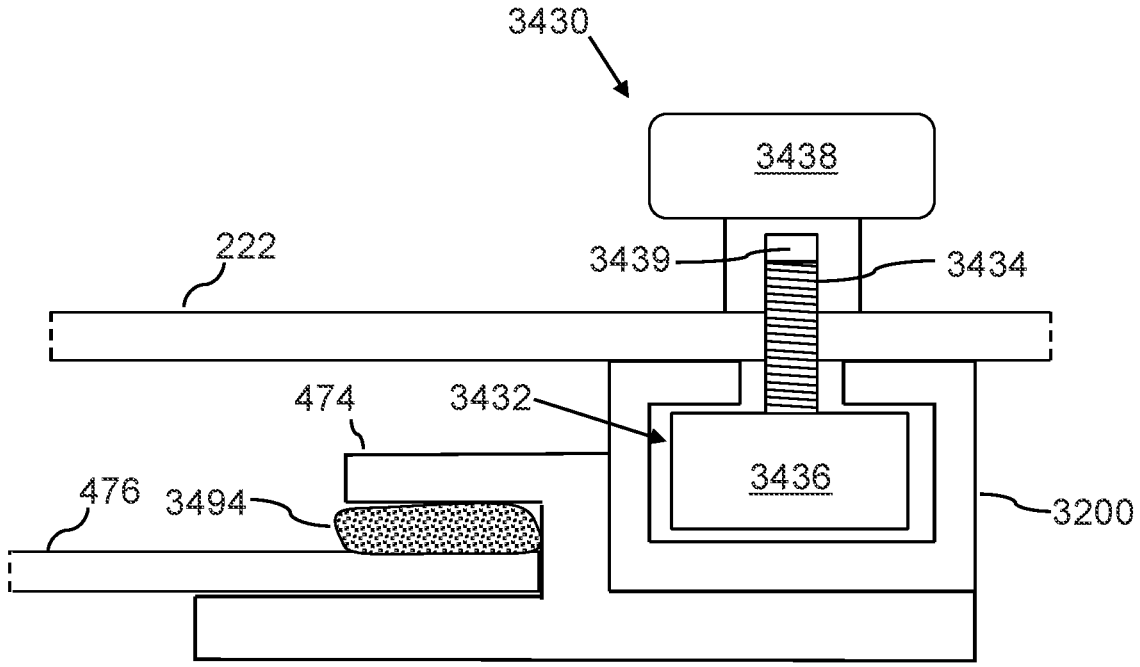
FIG. 34F is a top view of part of a slidable window assembly with a right slidable screw assembly, according to an embodiment of the invention.
Figure 35:
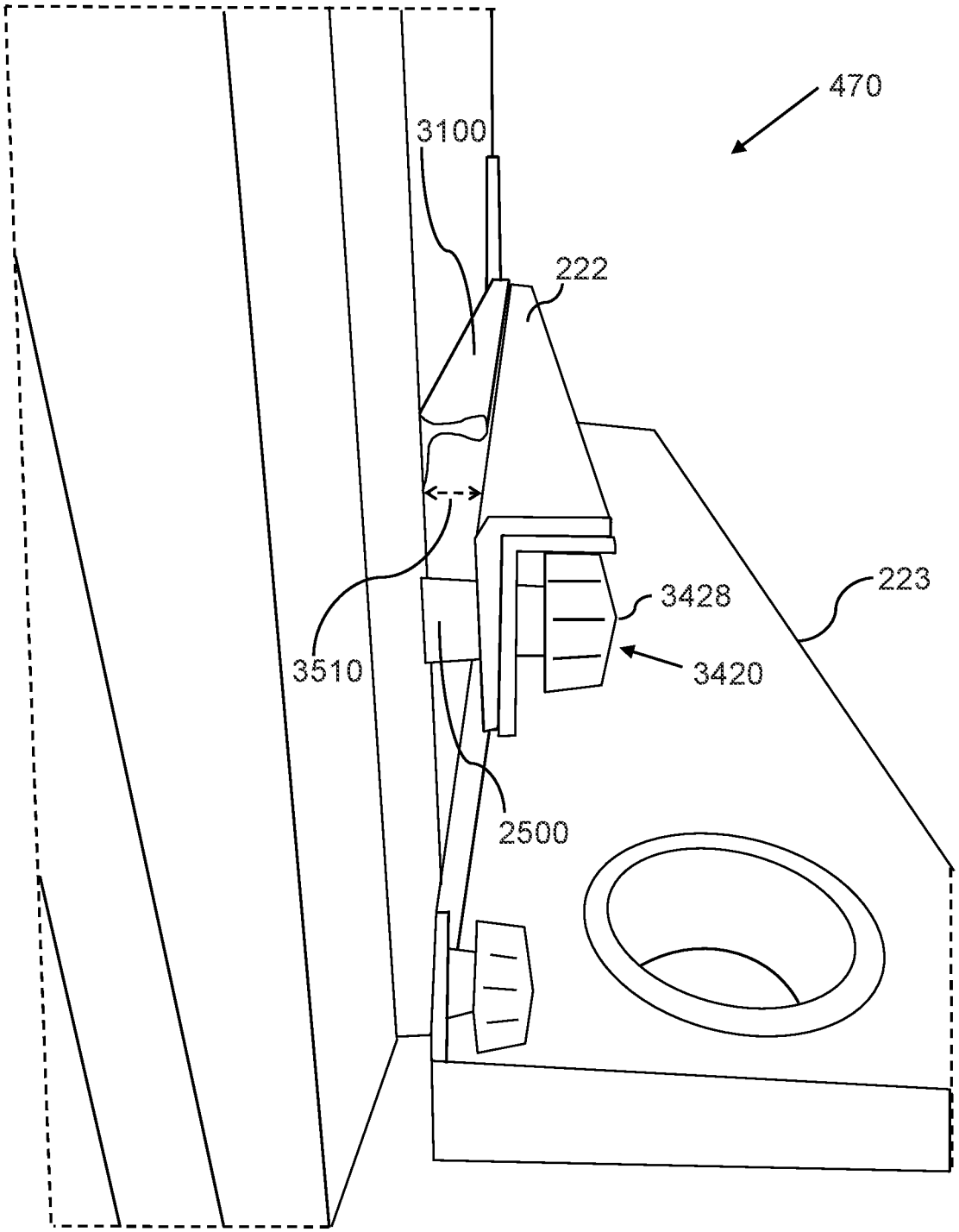

In a further related embodiment, as shown in FIGS. 34B, 34E, and 34F, the at least one slidable window assembly 470 can further include:

a) a left elongated friction fitting 3492, which for example can be made of felt or a slick closed-cell foam, wherein the left elongated friction fitting 3492 can be positioned along an inner surface of a left outer side of the window piece 476, such that the left elongated friction fitting 3492 slides inside the left groove 3473; and b) a right elongated friction fitting 3494, which for example can be made of felt or a slick closed-cell foam, wherein the right elongated friction fitting 3494 can be positioned along an inner surface of a right outer side of the window piece 476, such that the left elongated friction fitting 3492 slides inside the right groove 3475;

such that the left elongated friction fitting 3492 and the right elongated friction fitting 3494 provides smooth sliding and water and weather sealing of the at least one slidable window assembly 470.

In a further related embodiment, as shown in FIG. 34E, the at least one slidable window assembly 470 can further include:

a) a left slidable screw assembly 3420, which can include:

i. a left slidable screw 3422, which can include:

1) a left threaded shaft 3424; and 2) a left slidable head 3426, which is connected to an inner end of the left threaded shaft 3424;

wherein the left slidable head 3426 is configured to be slidable inside the left elongated rail interior 3215; and ii. a left tightening nut 3428, which can include a threaded interior 3429, such that the left tightening nut 3428 is configured to screw onto the left threaded shaft 3424; and b) a right slidable screw assembly 3430, which can include:

i. a right slidable screw 3432, which can include:

1) a right threaded shaft 3434; and 2) a right slidable head 3436, which is connected to an inner end of the right threaded shaft 3434;

wherein the right slidable head 3436 is configured to be slidable inside the right elongated rail interior 3445; and ii. a right tightening nut 3438, which can include a threaded interior 3439, such that the right tightening nut 3438 is configured to screw onto the right threaded shaft 3434;

wherein the at least one horizontal elongated object assembly 222, 223 comprises a left screw aperture 2202, 2302 and a right screw aperture 2204, 2304;

wherein the left slidable head 3426 is slidably positioned inside the left elongated rail interior 3215; and the right slidable head 3436 is slidably positioned inside the right elongated rail interior 3445;

such that the left threaded shaft 3424 protrudes through the left elongated rail slit 3211 and the left screw aperture 2202, 2302;

such that the right threaded shaft 3434 protrudes through the right elongated rail slit 3442 and the right screw aperture 2204, 2304;

such that the left tightening nut 3428 and the right tightening nut 3438 can be tightened (i.e., are tightenable) on the left threaded shaft 3424 and the right threaded shaft 3434, respectively;

such that the at least one horizontal elongated object assembly 222, 223 is locked in position when the left tightening nut 3428 and the right tightening nut 3438 are tightened;

such that the at least one horizontal elongated object assembly 222, 223 is vertically slidably adjustable 3479 when the left tightening nut 3428 and the right tightening nut 3438 are loosened.

In a yet further related embodiment, as shown in FIGS. 22A, 22B, 22C, 22D and 34A, the at least one horizontal elongated object assembly 222 can be configured as an L-shaped shooting bar 222, which can be used as a rifle support for use by a hunter when shooting with a rifle from the window aperture 250.

In a yet further related embodiment, as shown in FIGS. 24A, 24B, 24C, 24D and 34A, the at least one horizontal elongated object assembly 223 can be configured as a lower shelf 224, which can be slidably mounted underneath the window aperture 250, or as an upper shelf 223, as shown in FIGS. 23A, 23B, 23C, 23D, which can be slidably mounted above (or potentially along) the window aperture 250.

In a related embodiment, as shown in FIGS. 34A-34B, 31A, 31B, 31C, 31D, and 31E, the at least one slidable window assembly 470 can further include:

a) a window handle 3100, which can include:

i. a u-shaped elongated portion 3110, which is configured to attach along a bottom of the window piece 476, for example using screws, a silicone adhesive, or a friction fit using a plastic insert; and ii. an inward pointing elongated handle flange 3120, which is connected along an inner side of the u-shaped elongated portion 3110, such that the inward pointing elongated handle flange 3120, is accessible to facilitate opening and closing of the window piece 476.

In a further related embodiment, as shown in FIGS. 35, 25A, 25B, 25C, and 35, the left slidable screw assembly 3420 and the right slidable screw assembly 3430 can each further include:

a) a shooting rail spacer 2500, which comprises a protruding spacer aperture 2510;

wherein the shooting rail spacer 2500 can be positioned between the (left or right) corresponding vertical rail 3410, 3440 and the L-shaped shooting bar 222, such that the corresponding threaded shaft 3424 penetrates the protruding spacer aperture 2510 of the shooting rail spacer 2500;

such that the shooting rail spacer 2500 ensures that there is a separation gap 3510 between the window aperture 250 and the L-shaped shooting bar 222, such that the separation gap 3510 ensures that the L-shaped shooting bar 222 can slide vertically without impacting with the window handle 3100.

In a further related embodiment, as shown in FIGS. 26A, 26B, 26C, and 26D, the at least one slidable window assembly 470 can further include:

a) a window jamb header trim 2600, which can be mounted in the window aperture 250.

In a further related embodiment, as shown in FIGS. 27A, 27B, 27C, 27D, and 27E the at least one slidable window assembly 470 can further include:

a) a window header trim 2700, which can be mounted in the window aperture 250.

In a further related embodiment, as shown in FIGS. 28A, 28B, 28C, 28D, and 28E the at least one slidable window assembly 470 can further include:

a) a windowsill 2800, which can be mounted in a bottom of the window aperture 250.

Figure 29A:
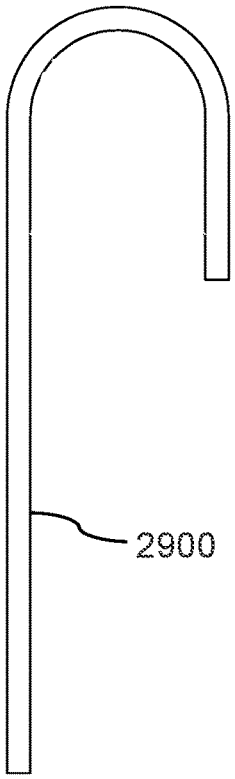
FIG. 29A is a top view of a ladder hook, according to an embodiment of the invention.
Figure 29B:
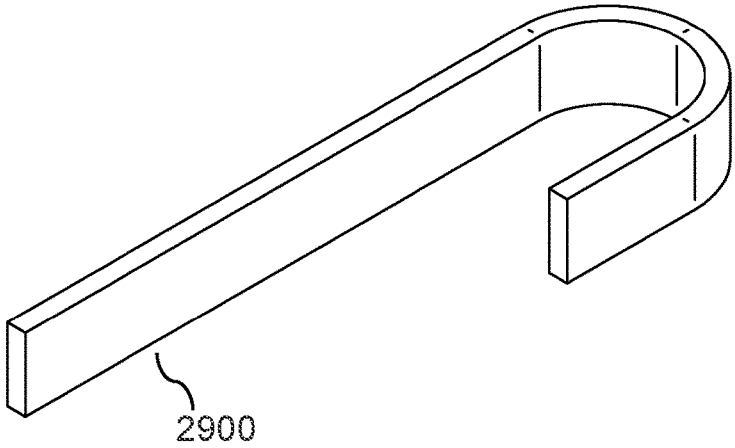
FIG. 29B is a perspective view of a ladder hook, according to an embodiment of the invention.
Figure 29C:
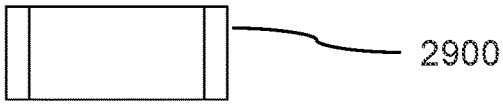
FIG. 29C is a front view of a ladder hook, according to an embodiment of the invention.
Figure 30A:
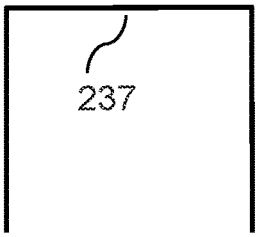
FIG. 30A is a front view of a u-shaped brackets, according to an embodiment of the invention.
Figure 30B:
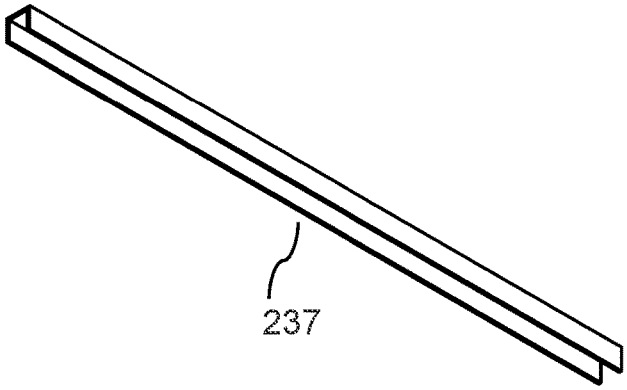
FIG. 30B is a bottom perspective view of a u-shaped bracket, according to an embodiment of the invention.
Figure 30C:
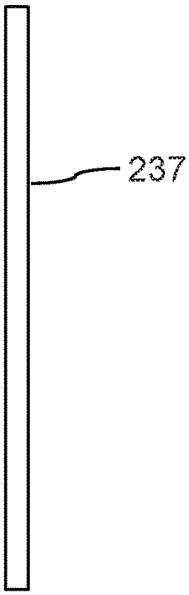
FIG. 30C is a top view of a u-shaped bracket, according to an embodiment of the invention.
Figure 30D:
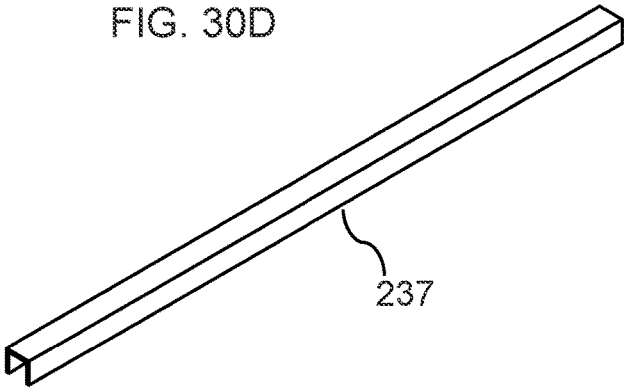
FIG. 30D is a top perspective view of a u-shaped bracket, according to an embodiment of the invention.
Figure 30E:
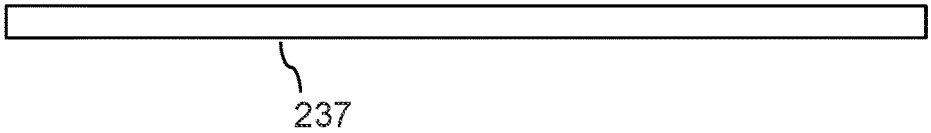
FIG. 30E is a side view of a u-shaped bracket, according to an embodiment of the invention.
Figure 31A:
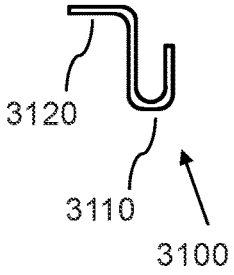
FIG. 31A is a side view of a window handle, according to an embodiment of the invention.
Figure 31B:
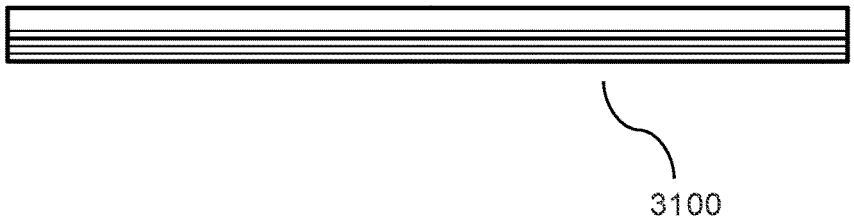
FIG. 31B is a top view of a window handle, according to an embodiment of the invention.
Figure 31C:
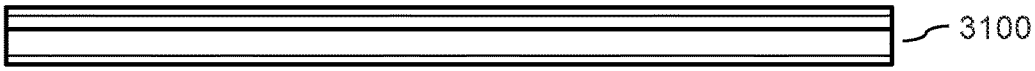
FIG. 31C is a front view of a window handle, according to an embodiment of the invention.
Figure 31D:
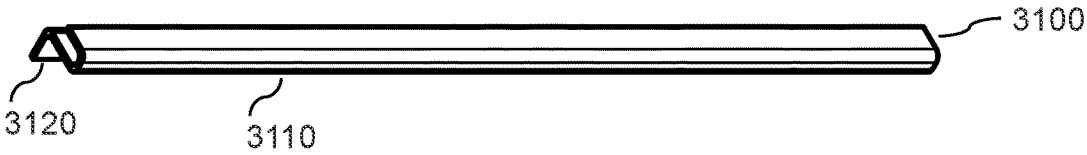
FIG. 31D is a first bottom perspective view of a window handle, according to an embodiment of the invention.
Figure 31E:
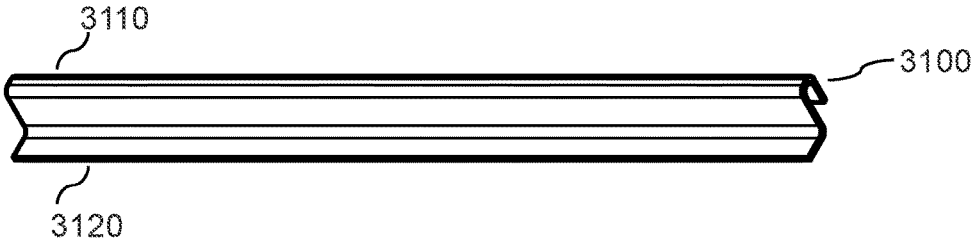
FIG. 31E is a second bottom perspective view of a window handle, according to an embodiment of the invention.

In a further related embodiment, as shown in FIGS. 29A, 29B, and 29C the modular building system 100 can further include:

a) a ladder hook 2900, which can be mounted on a side of the modular building assembly 102, such that the ladder hook can carry a ladder.

Thus, in related embodiments, the modular building system 100 can be a panelized building, which can include, floor, 4 wall panels, roof panel, door, windows and a platform. It can be put together and taken apart from standing on the platform as all fasteners are interior. The modular building system 100 can be made from all weather and mold resistant materials, such that there are no rottable materials used. The panelized structure removes the need for any equipment for erection, which saves time and money for the consumer. The corner connection technology, using corner brackets 203, allows for interior fasteners as well as locking the panels together in a watertight application, which enables the modular building system 100 to be used in a variety of applications, such as recreational applications, for example for hunting and fishing; and for emergency sheltering for displaced people and for other people that are temporarily homeless.

In related embodiments, the base platform 180 can be made of welded tubing, braked angle, composite floor decking, and a floor covering. The walls can be made of 2" rigid insulation panels that are adhered with aluminum or steel panels. The door can be a lockable, insulated, aluminum framed panel. The windows are track sliding with applied friction felt. The roof panel is a composite panel with a perimeter angle that is attached to the inside wall panels The modular building system 100 removes the necessity for use of any heavy equipment, such as forklifts, tractors, or other fork type lifts, and also removes the need for a team of people to erect. Furthered, the panel structure of the modular building system 100 allows easy dismantling and storage in a limited space area.

Here has thus been described a multitude of embodiments of the modular building system 100, and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

Many such alternative configurations are readily apparent and should be considered fully included in this specification and the claims appended hereto. Accordingly, since numerous modifications and variations will readily occur to those skilled in the art, the invention is not limited to the exact construction and operation illustrated and described, and thus, all suitable modifications and equivalents may be resorted to, falling within the scope of the invention.

What is claimed is:

1. A modular building system, comprising a modular building assembly, which comprises:

a) a base mounting structure, comprising:

a first base angle bracket; and a second base angle bracket;

wherein each base angle bracket is configured with an L-shaped cross-sectional profile, which comprises a vertical portion and a horizontal portion, such that a lateral center line of each base angle bracket is bent at a 90-degree angle;

such that a first outer end of the first base angle bracket is connected to a first outer end of the second base angle bracket; and such that a second outer end of the first base angle bracket is connected to a second outer end of the second base angle bracket;

b) a left receiving wall assembly, comprising:

a left primary wall assembly;

a left front corner bracket, which is mounted along a front vertical side of the left primary wall assembly; and a left rear corner bracket, which is mounted along a rear vertical side of the left primary wall assembly;

such that the left receiving wall assembly is mounted on a left side of the base mounting structure;

c) a right receiving wall assembly, comprising:

a right primary wall assembly;

a right front corner bracket, which is mounted along a front vertical side of the right primary wall assembly; and a right rear corner bracket, which is mounted along a rear vertical side of the right primary wall assembly;

such that the right receiving wall assembly is mounted on an opposing right side of the base mounting structure;

such that a front mounting opening is formed between the left front corner bracket and the right front corner bracket; and such that a rear mounting opening is formed between the left rear corner bracket and the right rear corner bracket;

d) a front wall assembly, which is mounted in the front mounting opening; and e) a rear wall assembly, which is mounted in the rear mounting opening.

2. The modular building system of claim 1, further comprising:

a platform, which comprises legs;

such that the modular building assembly is positionable on a top surface of the platform, when the legs of the platform are positioned on a mounting surface.

3. The modular building system of claim 2, wherein the top surface of the platform further comprises:

a porch surface;

such that the porch surface is exposed in a front of the modular building assembly, when the modular building assembly is positioned on the top surface of the platform.

4. The modular building system of claim 1, wherein each corresponding corner bracket of the left front corner bracket, the left rear corner bracket, the right front corner bracket, and the right rear corner bracket further comprises:

a u-shaped elongated corner bracket portion, which is configured to be positioned on and along a vertical side of a first corresponding wall assembly of the left primary wall assembly and the right primary wall assembly.

5. The modular building system of claim 4, wherein the u-shaped elongated corner bracket portion further comprises:

a) an outer elongated flange, which is configured to be positioned along an outside surface of the first corresponding wall assembly, adjacent to the vertical side of the first corresponding wall assembly;

b) an inner elongated flange, which is configured to be positioned along an inside surface of the first corresponding wall assembly adjacent to the vertical side of the first corresponding wall assembly; and c) an elongated bridge portion, which is connected between inner ends of the outer elongated flange and the inner elongated flange.

6. The modular building system of claim 5, wherein the u-shaped elongated corner bracket portion further comprises:

an inward elongated flange portion, which is perpendicularly mounted along an outer end of the inner elongated flange, such that the inward elongated flange portion is configured to hold a second corresponding wall assembly of the front wall assembly and the rear wall assembly in position in a corresponding mounting opening of the front mounting opening and the rear mounting opening.

7. The modular building system of claim 6, wherein an outer surface of the second corresponding wall assembly is flush with an outer surface of the elongated bridge portion of the corresponding corner bracket.

8. The modular building system of claim 1, wherein the left primary wall assembly, the right primary wall assembly, the front wall assembly, and the rear wall assembly each comprises:

a panel assembly, comprising:

an outside wall panel;

an intermediate panel; and an inside wall panel;

wherein the intermediate panel is positioned between the outside wall panel and the inside wall panel.

9. The modular building system of claim 1, wherein a corresponding wall assembly of the left primary wall assembly, the right primary wall assembly, the front wall assembly, and the rear wall assembly further comprises at least one window aperture, wherein the modular building assembly further comprises:

at least one slidable window assembly, further comprising a window piece, which is configured to be slidable to open and close the slidable window assembly.

10. The modular building system of claim 9, wherein the at least one slidable window assembly further comprises:

a) a left window groove assembly, which comprises a left groove, wherein the left window groove assembly is mounted on a left side of the at least one window aperture; and b) a right window groove assembly, which comprises a right groove, wherein the left window groove assembly is mounted on a right side of the at least one window aperture;

wherein a left side of the window piece is slidably mounted inside the left groove; and wherein a right side of the window piece is slidably mounted inside the right groove;

such that the window piece is vertically slidably mounted between the left window groove assembly and the right window groove assembly.

11. The modular building system of claim 10, wherein each of the left window groove assembly and the right window groove assembly further comprises:

a) an outside vertical groove flange;

b) an inside vertical groove flange; and c) a vertical groove bottom, which is connected along and between inner ends of the outside vertical groove flange and the inside vertical groove flange.

12. The modular building system of claim 11, wherein each of the left window groove assembly and the right window groove assembly further comprises:

a rear support flange, which is connected along an outside end of the vertical groove bottom, such that the rear support flange is parallel with and a continuation of the outside vertical groove flange;

wherein the at least one slidable window assembly further comprises:

a left vertical rail, which comprises a left elongated rail slit, which provides access to a left elongated rail interior; and a right vertical rail, which comprises a right elongated rail slit, which provides access to a right elongated rail interior;

wherein the left vertical rail and the right vertical rail are mounted on respectively left and right sides of the window aperture;

such that the left vertical rail is connected to the left window groove assembly, along a left inner surface of a left rear support flange of the left window groove assembly;

such that the right vertical rail is connected to the right window groove assembly, along a right inner surface of a right rear support flange of the right window groove assembly;

such that the at least one slidable window assembly is configured to enable at least one horizontal elongated object assembly to be vertically slidably and lockably connected between the left vertical rail and the right vertical rail.

13. The modular building system of claim 9, wherein the at least one slidable window assembly further comprises:

a left vertical rail, which comprises a left elongated rail slit, which provides access to a left elongated rail interior; and a right vertical rail, which comprises a right elongated rail slit, which provides access to a right elongated rail interior;

wherein the left vertical rail and the right vertical rail are mounted on respectively left and right sides of the window aperture;

such that the at least one slidable window assembly is configured to enable at least one horizontal elongated object assembly to be vertically slidably and lockably connected between the left vertical rail and the right vertical rail.

14. The modular building system of claim 13, wherein the left vertical rail and the right vertical rail each further comprises:

a) a first L-shaped side flange, including a first side portion and a first inward protruding portion;

b) a second L-shaped side flange, including a second side portion and a second inward protruding portion; and c) a rail bottom, such that inner ends of the first side portion and the second side portion are connected along respectively first and second sides of the rail bottom;

such that a corresponding elongated rail slit is formed between the first inward protruding portion and the second inward protruding portion.

15. The modular building system of claim 13, wherein the at least one slidable window assembly further comprises:

a) a left slidable screw assembly, comprising:

a left slidable screw, comprising:

a left threaded shaft; and a left slidable head, which is connected to an inner end of the left threaded shaft;

wherein the left slidable head is configured to be slidable inside the left elongated rail interior; and a left tightening nut, which comprises a left threaded interior, such that the left tightening nut is configured to screw onto the left threaded shaft; and b) a right slidable screw assembly, comprising:

a right slidable screw, comprising:

a right threaded shaft; and a right slidable head, which is connected to an inner end of the right threaded shaft;

wherein the right slidable head is configured to be slidable inside the right elongated rail interior; and a right tightening nut, which comprises a right threaded interior, such that the right tightening nut is configured to screw onto the right threaded shaft;

wherein the at least one horizontal elongated object assembly comprises a left screw aperture and a right screw aperture;

wherein the left slidable head is slidably positioned inside the left elongated rail interior; and the right slidable head is slidably positioned inside the right elongated rail interior;

such that the left threaded shaft protrudes through the left elongated rail slit and the left screw aperture;

such that the right threaded shaft protrudes through the right elongated rail slit and the right screw aperture;

such that the left tightening nut and the right tightening nut are tightenable on the left threaded shaft and the right threaded shaft, respectively;

such that the at least one horizontal elongated object assembly is locked in position when the left tightening nut and the right tightening nut are tightened;

such that the at least one horizontal elongated object assembly is vertically slidably adjustable when the left tightening nut and the right tightening nut are loosened.

16. The modular building system of claim 15, wherein the at least one horizontal elongated object assembly is configured as an L-shaped shooting bar.

17. The modular building system of claim 13, wherein the at least one horizontal elongated object assembly is configured as a shelf.

18. The modular building system of claim 10, wherein the at least one slidable window assembly further comprises:

a) a left elongated friction fitting, which is positioned along an inner surface of a left outer side of the window piece, such that the left elongated friction fitting slides inside the left groove; and b) a right elongated friction fitting, which is positioned along an inner surface of a right outer side of the window piece, such that the left elongated friction fitting slides inside the right groove;

such that the left elongated friction fitting and the right elongated friction fitting provide smooth sliding and weather sealing of the at least one slidable window assembly.

19. The modular building system of claim 16, wherein the at least one slidable window assembly further comprises:

a window handle, comprising:

a u-shaped elongated portion, which is configured to attach along a bottom of the window piece; and an inward pointing elongated handle flange, which is connected along an inner side of the u-shaped elongated portion, such that the inward pointing elongated handle flange, is accessible to facilitate opening and closing of the window piece.

20. The modular building system of claim 19, wherein the left slidable screw assembly and the right slidable screw assembly each further comprises:

a shooting rail spacer, which comprises a protruding spacer aperture;

wherein the shooting rail spacer is positioned between a corresponding vertical rail and the L-shaped shooting bar, such that a corresponding threaded shaft penetrates the protruding spacer aperture of the shooting rail spacer;

such that the shooting rail spacer ensures that there is a separation gap between the window aperture and the L-shaped shooting bar, such that the separation gap ensures that the L-shaped shooting bar slides vertically without impacting with the window handle.

21. The modular building system of claim 1, wherein each of the left receiving wall assembly, the rear wall assembly, the right receiving wall assembly, and the front wall assembly comprises:

a plurality of screw apertures along inside side edges of a corresponding wall assembly; and wherein the modular building assembly further comprises:

a plurality of screws;

such that each corresponding screw is screwed through a corresponding corner bracket into a corresponding screw aperture, from an interior of the modular building assembly;

whereby the corresponding wall assembly is secured to the corresponding corner bracket.

22. The modular building system of claim 1, wherein each of the left receiving wall assembly, the rear wall assembly, the right receiving wall assembly, and the front wall assembly comprises:

a plurality of screw apertures along inside bottom edges of a corresponding wall assembly; and wherein the modular building assembly further comprises:

a plurality of screws;

such that each corresponding screw is screwed through a corresponding base angle bracket into a corresponding screw aperture, from an interior of the modular building assembly;

whereby the corresponding wall assembly is secured to the corresponding base angle bracket.

23. A modular building system, comprising a modular building assembly, which comprises:

a) a left receiving wall assembly, comprising:

a left primary wall assembly;

a left front corner bracket, which is mounted along a front vertical side of the left primary wall assembly; and a left rear corner bracket, which is mounted along a rear vertical side of the left primary wall assembly; and b) a right receiving wall assembly, comprising:

a right primary wall assembly;

a right front corner bracket, which is mounted along a front vertical side of the right primary wall assembly; and a right rear corner bracket, which is mounted along a rear vertical side of the right primary wall assembly;

such that a front mounting opening is formed between the left front corner bracket and the right front corner bracket; and such that a rear mounting opening is formed between the left rear corner bracket and the right rear corner bracket;

c) a front wall assembly, which is mounted in the front mounting opening;

d) a rear wall assembly, which is mounted in the rear mounting opening; wherein the modular building assembly further comprises: a base mounting structure, comprising: a first base angle bracket; and a second base angle bracket; wherein each base angle bracket is configured with an L-shaped cross-sectional profile, which comprises a vertical portion and a horizontal portion, such that a lateral center line of each base angle bracket is bent at a 90-degree angle; such that a first outer end of the first base angle bracket is connected to a first outer end of the second base angle bracket; such that the left receiving wall assembly is mounted on a left side of the base mounting structure; and such that the right receiving wall assembly is mounted on an opposing right side of the base mounting structure.

24. The modular building system of claim 23, wherein each corresponding corner bracket of the left front corner bracket, the left rear corner bracket, the right front corner bracket, and the right rear corner bracket further comprises:

a u-shaped elongated corner bracket portion, which is configured to be positioned on and along a vertical side of a first corresponding wall assembly of the left primary wall assembly and the right primary wall assembly.

25. The modular building system of claim 24, wherein the u-shaped elongated corner bracket portion further comprises:

a) an outer elongated flange, which is configured to be positioned along an outside surface of the first corresponding wall assembly, adjacent to the vertical side of the first corresponding wall assembly;

b) an inner elongated flange, which is configured to be positioned along an inside surface of the first corresponding wall assembly adjacent to the vertical side of the first corresponding wall assembly; and c) an elongated bridge portion, which is connected between inner ends of the outer elongated flange and the inner elongated flange.

26. The modular building system of claim 25, wherein the u-shaped elongated corner bracket portion further comprises:

an inward elongated flange portion, which is perpendicularly mounted along an outer end of the inner elongated flange, such that the inward elongated flange portion is configured to hold a second corresponding wall assembly of the front wall assembly and the rear wall assembly in position in a corresponding mounting opening of the front mounting opening and the rear mounting opening.

27. The modular building system of claim 23, wherein a corresponding wall assembly of the left primary wall assembly, the right primary wall assembly, the front wall assembly, and the rear wall assembly further comprises at least one window aperture, wherein the modular building assembly further comprises:

at least one slidable window assembly, which is configured to be slidable to open and close the slidable window assembly;

wherein the at least one slidable window assembly further comprises:

a) a window piece;

b) a left window groove assembly, which comprises a left groove, wherein the left window groove assembly is mounted on a left side of the at least one window aperture; and c) a right window groove assembly, which comprises a right groove, wherein the left window groove assembly is mounted on a right side of the at least one window aperture;

wherein a left side of the window piece is slidably mounted inside the left groove; and wherein a right side of the window piece is slidably mounted inside the right groove;

such that the window piece is vertically slidably mounted between the left window groove assembly and the right window groove assembly.

28. The modular building system of claim 27, wherein the at least one slidable window assembly further comprises:

a left vertical rail, which comprises a left elongated rail slit, which provides access to a left elongated rail interior; and a right vertical rail, which comprises a right elongated rail slit, which provides access to a right elongated rail interior;

wherein the left vertical rail and the right vertical rail are mounted on respectively left and right sides of the window aperture;

such that the at least one slidable window assembly is configured to enable at least one horizontal elongated object assembly to be vertically slidably and lockably connected between the left vertical rail and the right vertical rail.

29. The modular building system of claim 28, wherein the at least one slidable window assembly further comprises:

a) a left slidable screw assembly, comprising:

a left slidable screw, comprising:

a left threaded shaft; and a left slidable head, which is connected to an inner end of the left threaded shaft, wherein the left slidable head is configured to be slidable inside the left elongated rail interior; and a left tightening nut, which comprises a left threaded interior, such that the left tightening nut is configured to screw onto the left threaded shaft; and b) a right slidable screw assembly, comprising:

a right slidable screw, comprising:

a right threaded shaft; and a right slidable head, which is connected to an inner end of the right threaded shaft;

wherein the right slidable head is configured to be slidable inside the right elongated rail interior; and a right tightening nut, which comprises a right threaded interior, such that the right tightening nut is configured to screw onto the right threaded shaft;

wherein the at least one horizontal elongated object assembly comprises a left screw aperture and a right screw aperture;

wherein the left slidable head is slidably positioned inside the left elongated rail interior; and the right slidable head is slidably positioned inside the right elongated rail interior;

such that the left threaded shaft protrudes through the left elongated rail slit and the left screw aperture;

such that the right threaded shaft protrudes through the right elongated rail slit and the right screw aperture;

such that the left tightening nut and the right tightening nut are tightenable on the left threaded shaft and the right threaded shaft, respectively;

such that the at least one horizontal elongated object assembly is locked in position when the left tightening nut and the right tightening nut are tightened;

such that the at least one horizontal elongated object assembly is vertically slidably adjustable when the left tightening nut and the right tightening nut are loosened.

* * * * *